US009716956B2

(12) United States Patent
Okamura et al.

(10) Patent No.: US 9,716,956 B2
(45) Date of Patent: Jul. 25, 2017

(54) PIEZOELECTRIC THIN FILM RESONATOR AND METHOD OF FABRICATING THE SAME

(71) Applicant: TAIYO YUDEN CO., LTD., Tokyo (JP)

(72) Inventors: Ryuichi Okamura, Tokyo (JP); Hiroshi Kawakami, Tokyo (JP); Hiroomi Kaneko, Tokyo (JP); Shinji Taniguchi, Tokyo (JP); Tsuyoshi Yokoyama, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/142,925

(22) Filed: Apr. 29, 2016

(65) Prior Publication Data

US 2016/0353221 A1 Dec. 1, 2016

(30) Foreign Application Priority Data

May 28, 2015 (JP) ..... 2015-108870

(51) Int. Cl.
*H04R 25/00* (2006.01)
*H04R 31/00* (2006.01)
*H04R 17/00* (2006.01)

(52) U.S. Cl.
CPC ..... *H04R 31/006* (2013.01); *H04R 17/00* (2013.01); *H04R 17/005* (2013.01); *H04R 2201/003* (2013.01)

(58) Field of Classification Search
CPC ..... H04R 31/006; H04R 17/00; H04R 17/005
See application file for complete search history.

(56) References Cited

U.S. PATENT DOCUMENTS

2005/0140247 A1* 6/2005 Lee ..... H03H 3/04 310/320
2010/0019864 A1* 1/2010 Yokoyama ..... H03H 3/04 333/187

(Continued)

FOREIGN PATENT DOCUMENTS

JP 2005-198233 A 7/2005
JP 2009-194714 A 8/2009

(Continued)

*Primary Examiner* — Simon King
(74) *Attorney, Agent, or Firm* — Chen Yoshimura LLP

(57) ABSTRACT

A piezoelectric thin film resonator includes: a lower electrode and an upper electrode facing each other across a piezoelectric film; an insertion film inserted into the piezoelectric film, located in at least a part of an outer peripheral region in a resonance region and outside the outer peripheral region, and not located in a center region of the resonance region; a protective film on the upper electrode and the piezoelectric film; and a wiring line connecting to the lower electrode and covering an outer periphery of the protective film in an extraction region of the lower electrode, wherein in the extraction region, an outer periphery of the insertion film is further out than an outer periphery of the upper electrode and further in than an outer periphery of the piezoelectric film, and the outer periphery of the protective film is further out than the outer periphery of the insertion film.

8 Claims, 25 Drawing Sheets

(56) References Cited

U.S. PATENT DOCUMENTS

| | | | | |
|---|---|---|---|---|
| 2012/0200199 | A1* | 8/2012 | Taniguchi | H03H 3/04<br>310/348 |
| 2014/0210570 | A1* | 7/2014 | Nishihara | H03H 9/70<br>333/133 |

FOREIGN PATENT DOCUMENTS

| | | | |
|---|---|---|---|
| JP | 2011-091639 | A | 5/2011 |
| JP | 2014-161001 | A | 9/2014 |

* cited by examiner

PIEZOELECTRIC THIN FILM RESONATOR AND METHOD OF FABRICATING THE SAME

CROSS-REFERENCE TO RELATED APPLICATION

This application is based upon and claims the benefit of priority of the prior Japanese Patent Application No. 2015-108870, filed on May 28, 2015, the entire contents of which are incorporated herein by reference.

FIELD

A certain aspect of the present invention relates to a piezoelectric thin film resonator and a method of fabricating the same.

BACKGROUND

Acoustic wave devices using a piezoelectric thin film resonator have been used as filters and duplexers of wireless devices such as, for example, mobile phones. The piezoelectric thin film resonator has a structure designed to include a lower electrode and an upper electrode facing each other across a piezoelectric film. The region where the lower electrode and the upper electrode face each other across the piezoelectric film is a resonance region. There has been known an art that improves a Q-value by inserting an insertion film into the piezoelectric film as disclosed in Japanese Patent Application Publication No. 2014-161001 (Patent Document 1).

When wiring lines are connected to the upper electrode and the lower electrode of the piezoelectric thin film resonator disclosed in Patent Document 1, the piezoelectric film may degrade, and the characteristics may deteriorate and the reliability may be decreased.

SUMMARY OF THE INVENTION

According to an aspect of the present invention, there is provided a piezoelectric thin film resonator including: a substrate; a piezoelectric film that is located on the substrate; a lower electrode and an upper electrode that face each other across at least a part of the piezoelectric film; an insertion film that is inserted into the piezoelectric film, is located in at least a part of an outer peripheral region in a resonance region where the lower electrode and the upper electrode face each other across the piezoelectric film and outside the outer peripheral region, and is not located in a center region of the resonance region; a protective film that is formed on the upper electrode and the piezoelectric film; and a wiring line that connects to the lower electrode in an extraction region of the lower electrode, wherein in the extraction region of the lower electrode, an outer periphery of the insertion film is located further out than an outer periphery of the upper electrode and is located further in than an outer periphery of the piezoelectric film, an outer periphery of the protective film is located further out than the outer periphery of the insertion film, and the wiring line covers the outer periphery of the protective film.

According to another aspect of the present invention, there is provided a method of fabricating a piezoelectric thin film resonator including: forming, on a substrate, a piezoelectric film, a lower electrode and an upper electrode facing each other across at least a part of the piezoelectric film, and an insertion film inserted into the piezoelectric film, located in at least a part of an outer peripheral region in a resonance region where the lower electrode and the upper electrode face each other across the piezoelectric film, located outside the outer peripheral region, and not located in a center region of the resonance region so that in an extraction region of the lower electrode, an outer periphery of the insertion film is located further out than an outer periphery of the upper electrode and is located further in than an outer periphery of the piezoelectric film; forming a protective film on the upper electrode and the piezoelectric film; etching a part of the protective film so that in the extraction region of the lower electrode, an outer periphery of the protective film is located further out than the outer periphery of the insertion film; and forming a wiring line connecting to the lower electrode in the extraction region of the lower electrode so that the wiring line covers the outer periphery of the protective film in the extraction region of the lower electrode.

DETAILED DESCRIPTION

Hereinafter, embodiments of the present invention will be described with reference to accompanying drawings.

First Embodiment

Figure 1A:
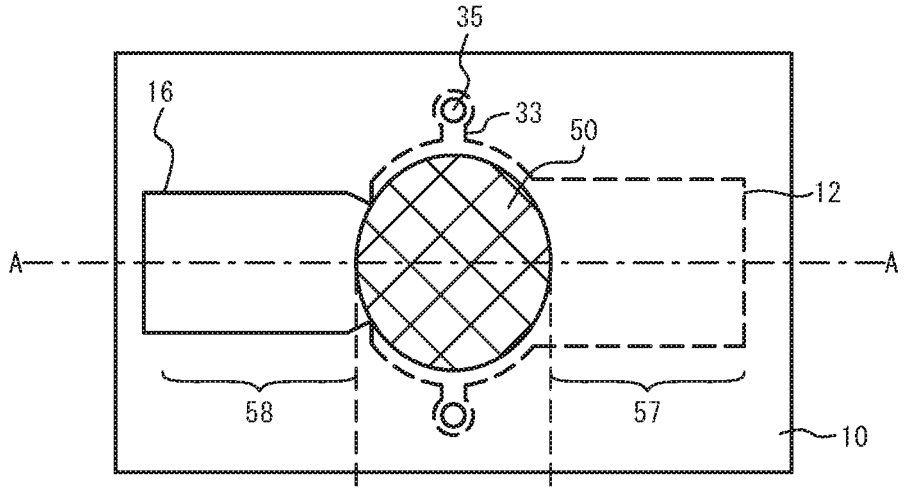
FIG. 1A is a plan view of a piezoelectric thin film resonator in accordance with a first embodiment.
Figure 1B:
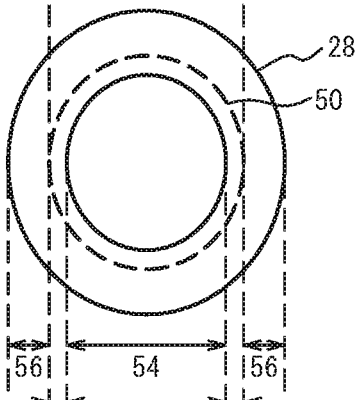
FIG. 1B is a plan view of an insertion film.
Figure 1C:
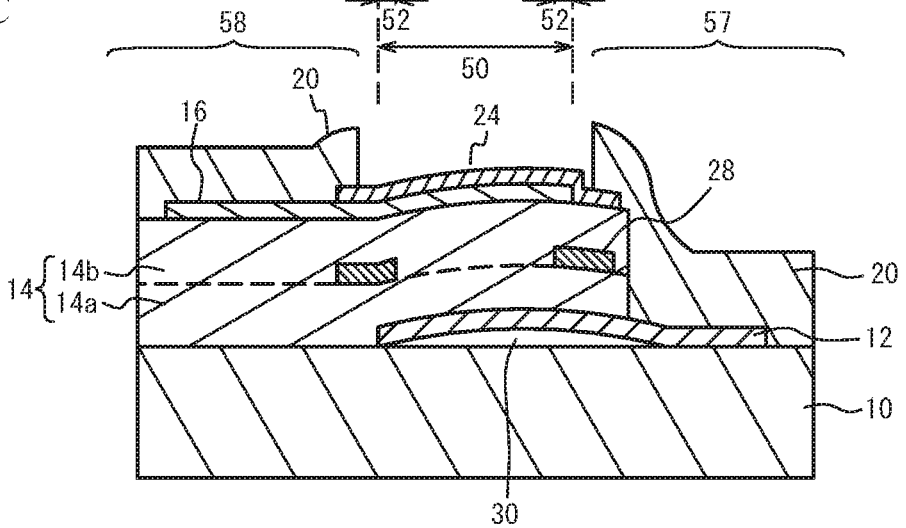
FIG. 1C is a cross-sectional view taken along line A-A in FIG. 1A.

FIG. 1A is a plan view of a piezoelectric thin film resonator in accordance with a first embodiment, FIG. 1B is a plan view of an insertion film, and FIG. 1C is a cross-sectional view taken along line A-A in FIG. 1A. As illustrated in FIG. 1A and FIG. 1C, a lower electrode 12 is located on a substrate 10. An air gap 30 having a dome-shaped bulge is formed between the flat principal surface of the substrate 10 and the lower electrode 12. The dome-shaped bulge is, for example, a bulge having a shape in which the height of the air gap 30 is low in the periphery of the air gap 30 and increases at closer distances to the center of the air gap 30.

Located on the lower electrode 12 is a piezoelectric film 14 mainly composed of aluminum nitride (AlN) having the main axis in the (002) direction. The piezoelectric film 14 includes piezoelectric films 14*a* and 14*b*. An insertion film 28 is located between the piezoelectric film 14*a* and the piezoelectric film 14*b*. An upper electrode 16 is located on the piezoelectric film 14 so as to have a region (a resonance region 50) in which the upper electrode 16 faces the lower electrode 12 across the piezoelectric film 14. The resonance region 50 has an elliptical shape, and is a region where the acoustic wave in the thickness extension mode resonates.

The lower electrode 12 is extracted from the resonance region 50 to an extraction region 57. The upper electrode 16 is extracted from the resonance region 50 to an extraction region 58. In the extraction region 57, the piezoelectric film 14 on the lower electrode 12 is removed, and a wiring line 20 is formed on the lower electrode 12. In the extraction region 58, the wiring line 20 is formed on the upper electrode 16. A protective film 24 is formed on the upper electrode 16 and the piezoelectric film 14.

As illustrated in FIG. 1B, the insertion film 28 is located in an outer peripheral region 52 in the resonance region 50, but is not located in a center region 54. The outer peripheral region 52 is within the resonance region 50, includes an outer periphery of the resonance region 50, and is along the outer periphery. The center region 54 is within the resonance region 50, and includes the center of the resonance region 50. The center may not be a geometric center. The insertion film 28 is located in a peripheral region 56 outside the resonance region 50. The insertion film 28 is continuously located from the outer peripheral region 52 to the peripheral region 56. As described above, the insertion film 28 is located in at least a part of the outer peripheral region 52 in the resonance region 50 and outside the outer peripheral region 52.

As illustrated in FIG. 1A, an introduction path 33 used to etch a sacrifice layer is formed in the lower electrode 12. The sacrifice layer is a layer used to form the air gap 30. The vicinity of the tip of the introduction path 33 is not covered with the piezoelectric film 14, and the lower electrode 12 includes a hole portion 35 at the tip of the introduction path 33.

A description will be given of a piezoelectric thin film resonator having a resonant frequency of 2 GHz as an example. A silicon (Si) substrate is used as the substrate 10. The lower electrode 12 is formed of a Cr (chrome) film with a film thickness of 100 nm and a Ru (ruthenium) film with a film thickness of 250 nm stacked in this order from the substrate 10 side. The piezoelectric film 14 is an AlN (aluminum nitride) film with a film thickness of 1100 nm. Each of the piezoelectric films 14*a* and 14*b* has a film thickness of 550 nm. The insertion film 28 is a silicon oxide ($SiO_2$) film with a film thickness of 150 nm. The upper electrode 16 is formed of a Ru film with a film thickness of 250 nm and a Cr film with a film thickness of 50 nm stacked in this order from the piezoelectric film 14 side. The protective film 24 is a silicon oxide film with a film thickness of 100 nm. The material for each layer and the film thickness of each layer may be selected as appropriate to obtain desired resonance characteristics.

The substrate 10 may be a quartz substrate, a glass substrate, a ceramic substrate, or a GaAs substrate instead of the silicon substrate. The lower electrode 12 and the upper electrode 16 may be formed of a single-layer film of Al (aluminum), Ti (titanium), Cu (copper), Mo (molybdenum), W (tungsten), Ta (tantalum), Pt (platinum), Rh (rhodium), or Ir (iridium), or a multilayered film of at least two of them instead of Ru and Cr. The protective film 24 may be a silicon nitride film or an aluminum nitride instead of the silicon oxide film. The wiring line 20 is formed of a metal layer such as copper or gold having low electric resistance.

The piezoelectric film 14 may be formed of ZnO (zinc oxide), PZT (lead zirconate titanate), $PbTiO_3$ (lead titanate) instead of aluminum nitride. Alternatively, for example, the piezoelectric film 14 may be mainly composed of aluminum nitride, and include other elements to improve the resonance characteristic and the piezoelectricity. For example, the use of Sc (scandium), two elements of a divalent element and a quadrivalent element, or two elements of a divalent element and a pentavalent element as an additive element improves the piezoelectricity of the piezoelectric film 14. Accordingly, the effective electromechanical coupling coefficient of the piezoelectric thin film resonator is improved. The divalent element is, for example, Ca (calcium), Mg (magnesium), Sr (strontium), or Zn (zinc). The quadrivalent element is, for example, Ti, Zr (zirconium), or Hf (hafnium). The pentavalent element is, for example, Ta, Nb (niobium), or V (vanadium).

The provision of the insertion film 28 improves the Q-value of the piezoelectric thin film resonator. To improve the Q-value, the Young's modulus of the insertion film 28 is preferably less than the Young's modulus of the piezoelectric film 14. In addition, the acoustic impedance (Young's modulus×density) of the insertion film 28 is preferably less than the acoustic impedance of the piezoelectric film 14. Al, Au, Cu, Ti, Pt, Ta, Cr, or silicon oxide, or a multilayered film of at least two of them may be used as the insertion film 28.

Figure 2A:
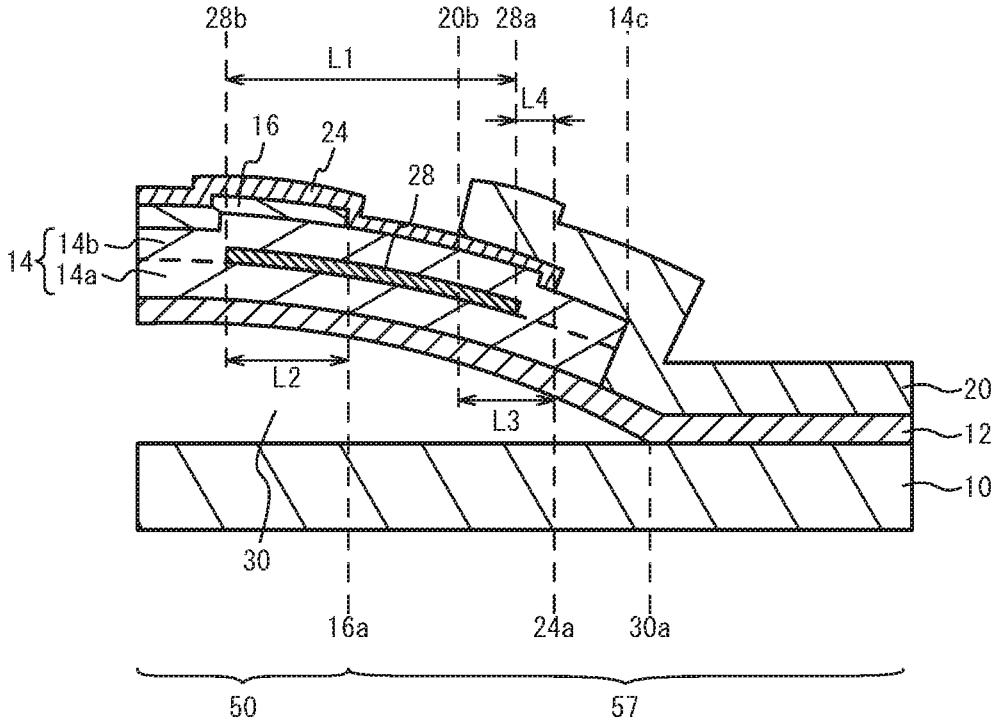
FIG. 2A and FIG. 2B are enlarged views around extraction regions of a lower electrode and an upper electrode of the first embodiment, respectively.
Figure 2B:
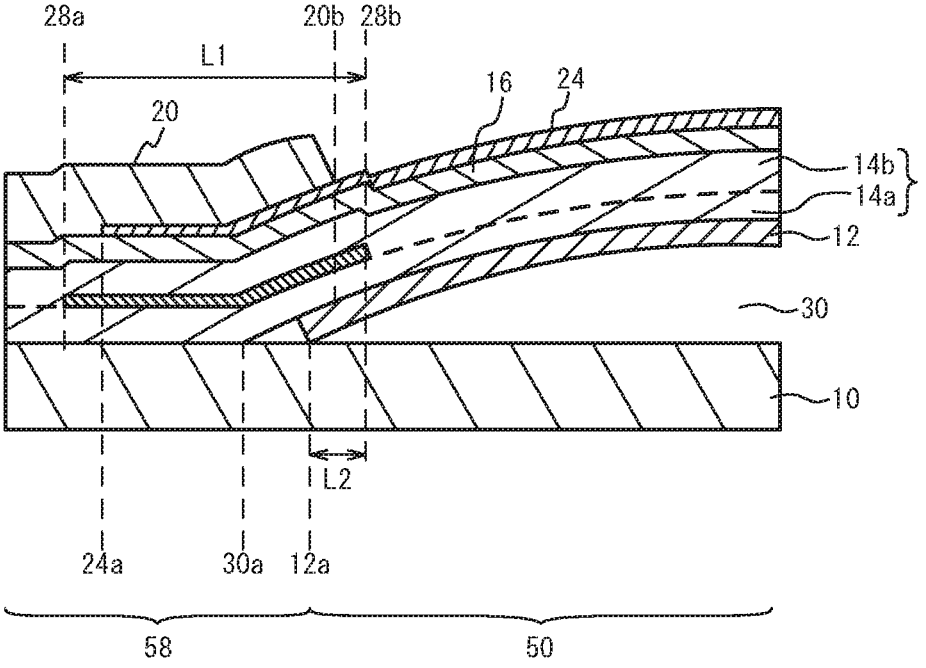

FIG. 2A and FIG. 2B are enlarged views around the extraction regions of the lower electrode and the upper electrode of the first embodiment, respectively. As illustrated in FIG. 2A, around the extraction region 57 of the lower electrode 12, an outer periphery 14*c* of the piezoelectric film 14 is located further in than an outer periphery 30*a* of the air gap 30. An outer periphery 24*a* of the protective film 24 is located further in than the outer periphery 14*c* of the piezoelectric film 14. An outer periphery 28*a* of the insertion film 28 is located further in than the outer periphery 24*a* of the protective film 24. An inner periphery 20*b* of the wiring line 20 is located further in than the outer periphery 28*a* of the insertion film 28. An outer periphery 16*a* of the upper electrode 16 is located further in than the inner periphery 20*b* of the wiring line 20. An inner periphery 28*b* of the insertion film 28 is located further in than the outer periphery 16*a* of the upper electrode 16.

As illustrated in FIG. 2B, around the extraction region 58 of the upper electrode 16, the outer periphery 24*a* of the protective film 24 is located further in than the outer periphery 28*a* of the insertion film 28. The outer periphery 30*a* of the air gap 30 is located further in than the outer periphery 24*a* of the protective film 24. An outer periphery 12*a* of the lower electrode 12 is located further in than the outer periphery 30*a* of the air gap 30. The inner periphery 20*b* of the wiring line 20 is located further in than the outer periphery 12*a* of the lower electrode 12. The inner periphery 28*b* of the insertion film 28 is located further in than the outer periphery 12*a* of the lower electrode 12.

The insertion film 28 has a film thickness of, for example, 50 to 300 nm. The insertion film 28 has a width L1 of, for example, 5 to 15 μm. A width L2 along which the resonance region 50 overlaps with the insertion film 28 is, for example, 1.5 to 4 μm. A width L3 along which the protective film 24 overlaps with the wiring line 20 in the extraction region 57 of the lower electrode 12 is, for example, 2 to 10 μm. A distance L4 between the outer periphery 24*a* of the protective film 24 and the outer periphery 28*a* of the insertion film 28 is, for example, 1 to 8 μm.

Figure 3A:
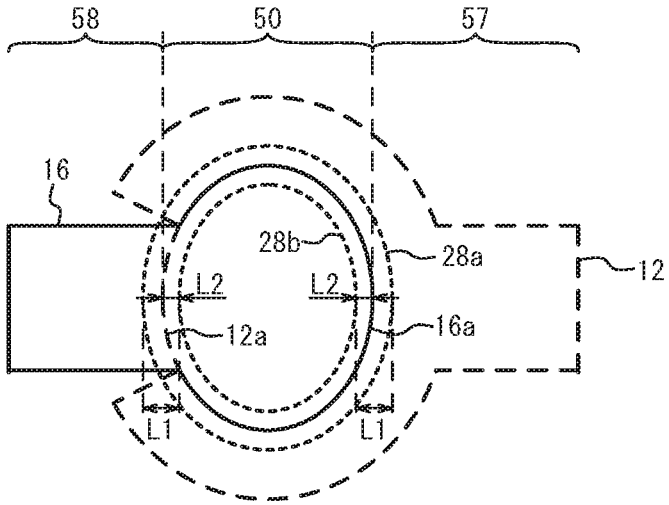
FIG. 3A is a plan view of the lower electrode, the upper electrode, and the insertion film.
Figure 3B:
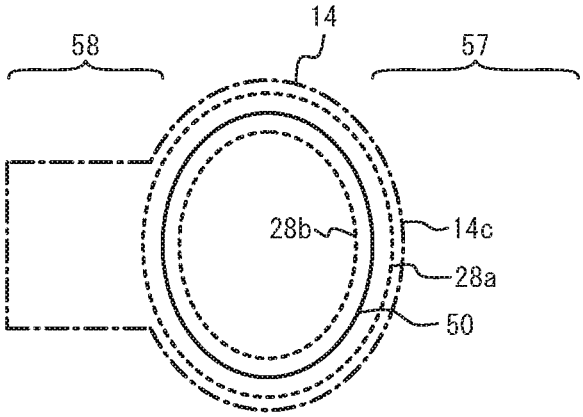
FIG. 3B is a plan view of a piezoelectric film, the insertion film, and a resonance region.
Figure 3C:
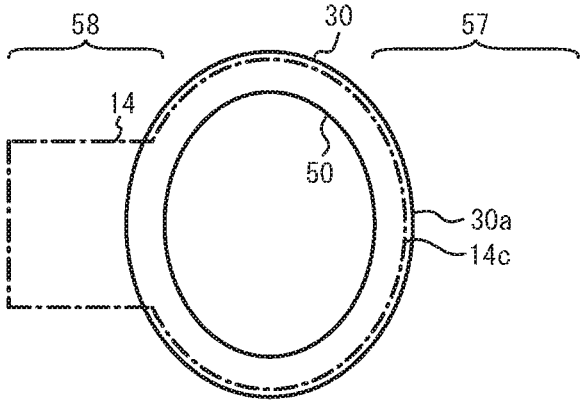
FIG. 3C is a plan view of the piezoelectric film, an air gap, and the resonance region.
Figure 4A:
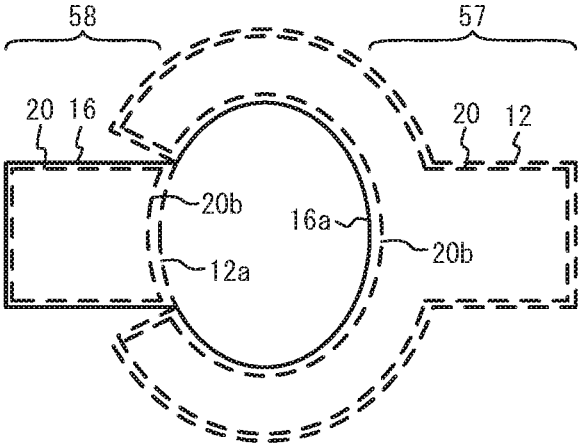
FIG. 4A is a plan view of a wiring line, the lower electrode, and the upper electrode.
Figure 4B:
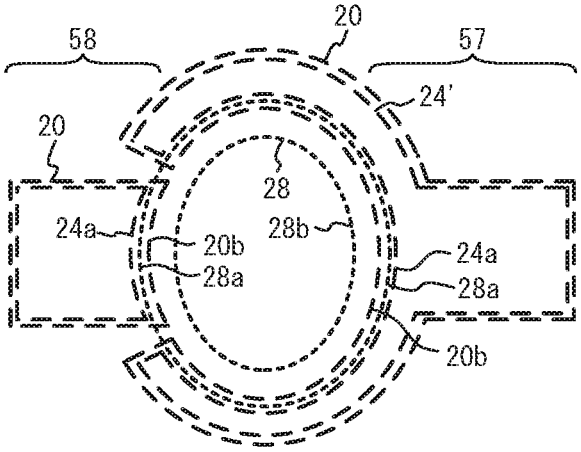
FIG. 4B is a plan view of a protective film, the wiring line, and the insertion film.

FIG. 3A is a plan view of the lower electrode, the upper electrode, and the insertion film, FIG. 3B is a plan view of the piezoelectric film, the insertion film, and the resonance region, and FIG. 3C is a plan view of the piezoelectric film, the air gap, and the resonance region. FIG. 4A is a plan view of the wiring line, the lower electrode, and the upper electrode, and FIG. 4B is a plan view of the protective film, the wiring line, and the insertion film.

As illustrated in FIG. 3A, a region where the lower electrode 12 overlaps with the upper electrode 16 corresponds to the resonance region 50 with an elliptical shape. The lower electrode 12 or the upper electrode 16 is located outside the outer periphery of the resonance region 50. The upper electrode 16 is located in the resonance region 50 and the extraction region 58. The lower electrode 12 is located in the resonance region 50 and the extraction region 57. The extraction regions 57 and 58 are opposed to each other across the resonance region 50. The lower electrode 12 is also located around the resonance region 50 except the extraction region 58. This configuration allows the area of the resonance region 50 to hardly change even when the lower electrode 12 and the upper electrode 16 are misaligned. The outer periphery 28*a* and the inner periphery 28*b* of the insertion film 28 have shapes similar to the shape of the resonance region 50. The outer periphery 28*a* of the insertion film 28 is located outside the resonance region 50. This configuration allows the change in the characteristics of the piezoelectric thin film resonator to be small even when the insertion film 28 and the lower electrode 12 and the upper electrode 16 are misaligned.

As illustrated in FIG. 3B, the piezoelectric film 14 is larger than the insertion film 28, and is located to include the insertion film 28. That is to say, the outer periphery 14*c* of the piezoelectric film 14 is located further out than the outer periphery 28*a* of the insertion film 28. This configuration eliminates the need for etching of the insertion film 28 at the time of etching of the piezoelectric film 14. Accordingly, the fabrication process is simplified. The piezoelectric film 14 is located also in the extraction region 58 of the upper electrode 16. As illustrated in FIG. 3C, the air gap 30 is larger than the resonance region 50, and is located to include the resonance region 50. Thus, the vibration in the resonance region 50 is not limited by the substrate 10. In the extraction region 57 of the lower electrode 12, the outer periphery 30*a* of the air gap 30 is located further out than the outer periphery 14*c* of the piezoelectric film 14.

As illustrated in FIG. 4A, the wiring line 20 is smaller than the lower electrode 12 and the upper electrode 16, and is located to be included in the lower electrode 12 or the upper electrode 16. The wiring line 20 is formed so as not to overlap with the resonance region 50. As illustrated in FIG. 4B, an aperture 24' in which the protective film 24 is not formed is smaller than the wiring line 20, and is located to be included in the wiring line 20. This configuration inhibits the piezoelectric film 14 or the like from being exposed from the aperture 24' of the protective film 24. The outer periphery 24*a* of the protective film 24 is located further out than the outer periphery 28*a* of the insertion film 28.

Figure 5A:
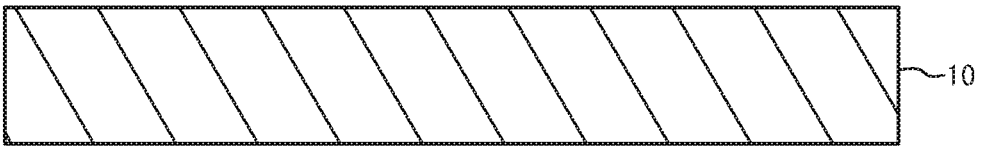
FIG. 5A through FIG. 5E are cross-sectional views (No. 1) illustrating a method of fabricating the piezoelectric thin film resonator of the first embodiment.
Figure 5B:
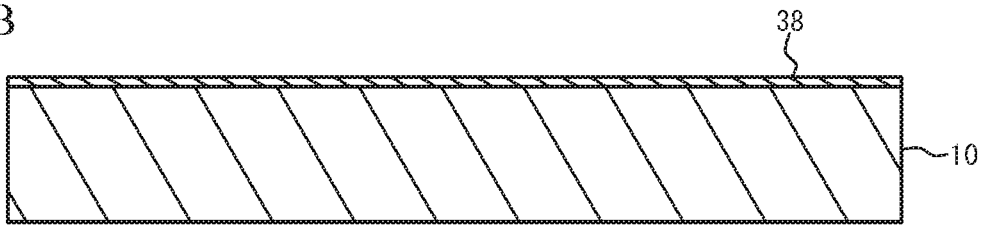

FIG. 5A through FIG. 7D are cross-sectional views illustrating a method of fabricating the piezoelectric thin film resonator of the first embodiment. As illustrated in FIG. 5A, the substrate 10 having a flat principal surface is prepared. As illustrated in FIG. 5B, a sacrifice layer 38 for forming an air gap is formed on the substrate 10. The sacrifice layer 38 has a film thickness of, for example, 10 to 100 nm, and is formed of a material selected from materials such as MgO (magnesium oxide), ZnO, Ge (germanium), or $SiO_2$ (silicon oxide) easily dissolving in an etching liquid or an etching gas. The sacrifice layer 38 is formed by, for example, sputtering, vacuum evaporation, or CVD (Chemical Vapor Deposition).

Figure 5C:
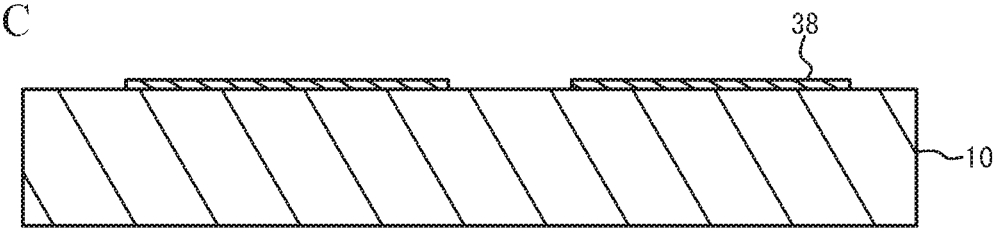
Figure 5D:
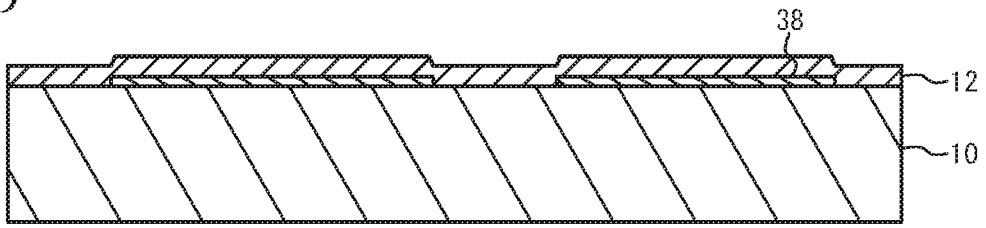
Figure 5E:
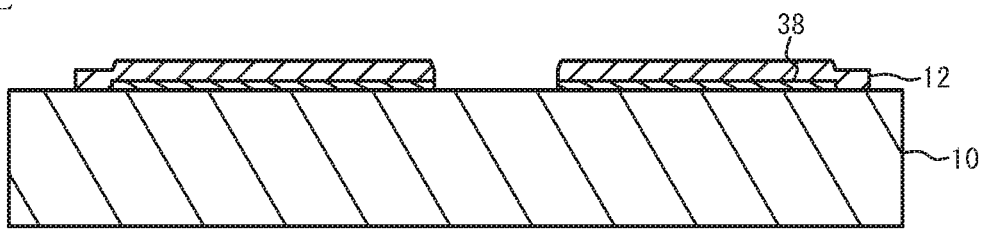

As illustrated in FIG. 5C, the sacrifice layer 38 is patterned into a desired shape by photolithography and etching. The shape of the sacrifice layer 38 corresponds to the planar shape of the air gap 30, and includes, for example, a region to be the resonance region 50. As illustrated in FIG. 5D, the lower electrode 12 is formed on the sacrifice layer 38 and the substrate 10. The lower electrode 12 is formed by, for example, sputtering, vacuum evaporation, or CVD (Chemical Vapor Deposition). As illustrated in FIG. 5E, the lower electrode 12 is patterned into a desired shape by photolithography and etching. The lower electrode 12 may be formed by liftoff.

Figure 6A:
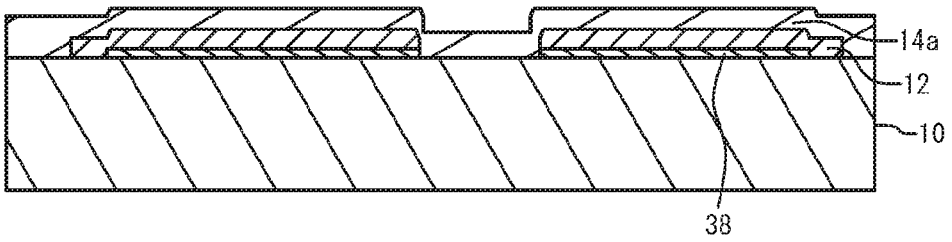
FIG. 6A through FIG. 6D are cross-sectional views (No. 2) illustrating the method of fabricating the piezoelectric thin film resonator of the first embodiment.
Figure 6B:
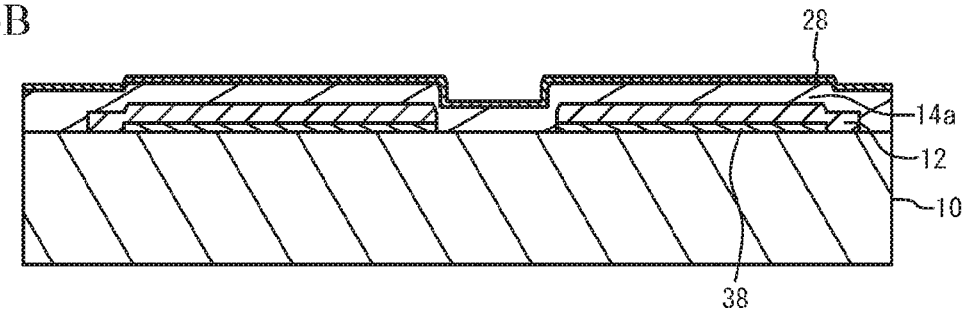
Figure 6C:
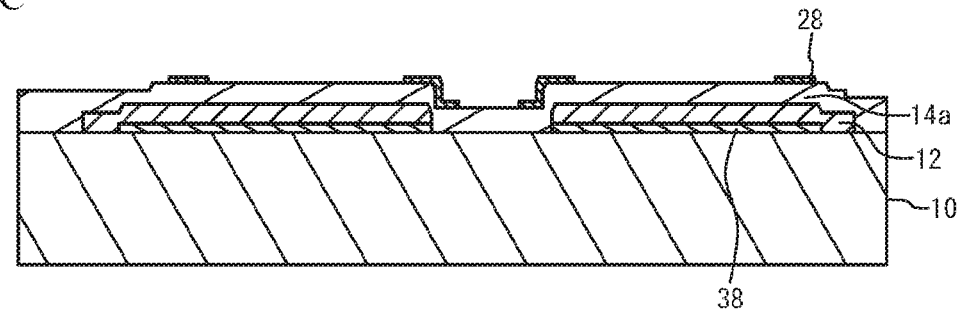
Figure 6D:
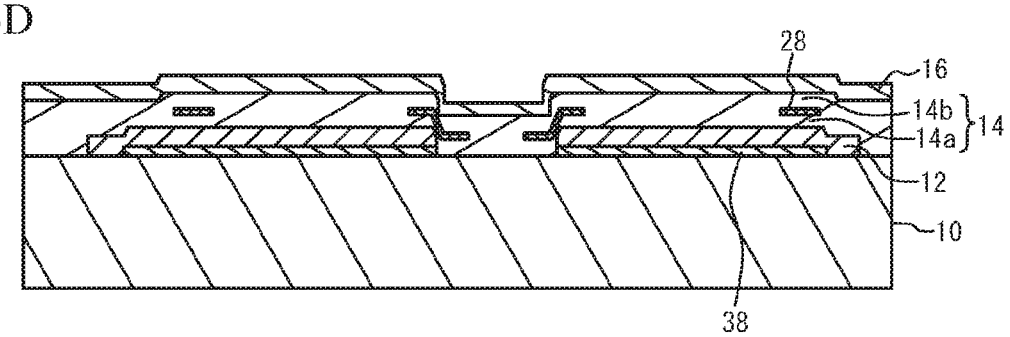

As illustrated in FIG. 6A, the piezoelectric film 14*a* is formed on the lower electrode 12 and the substrate 10 by, for example, sputtering, vacuum evaporation, or CVD. As illustrated in FIG. 6B, the insertion film 28 is formed on the piezoelectric film 14*a* by, for example, sputtering, vacuum evaporation, or CVD. As illustrated in FIG. 6C, the insertion film 28 is patterned into a desired shape by photolithography and etching. The insertion film 28 may be formed by liftoff. As illustrated in FIG. 6D, the piezoelectric film 14*b* and the upper electrode 16 are formed on the piezoelectric film 14*a* and the insertion film 28 by, for example, sputtering, vacuum evaporation, or CVD. The piezoelectric films 14*a* and 14*b* form the piezoelectric film 14.

Figure 7A:
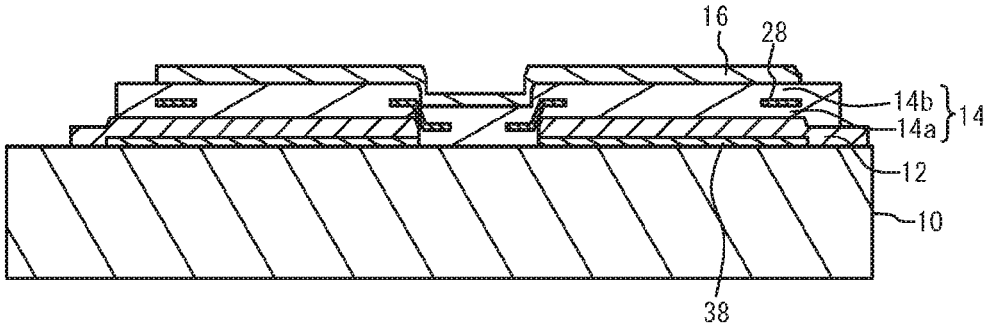
FIG. 7A through FIG. 7D are cross-sectional views (No. 3) illustrating the method of fabricating the piezoelectric thin film resonator of the first embodiment.
Figure 7B:
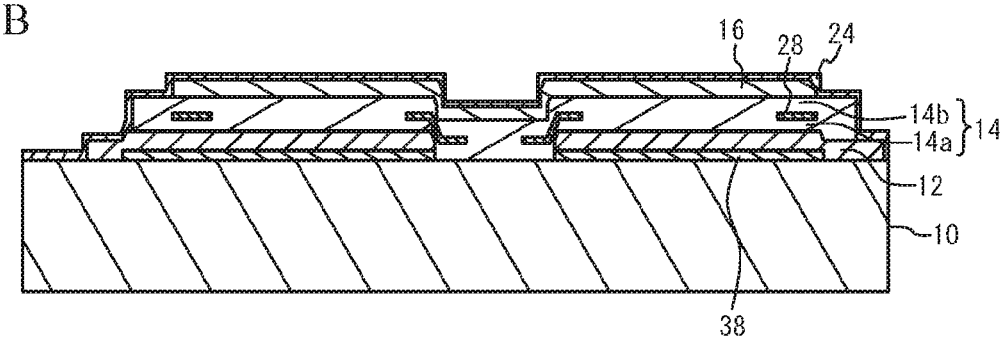
Figure 7C:
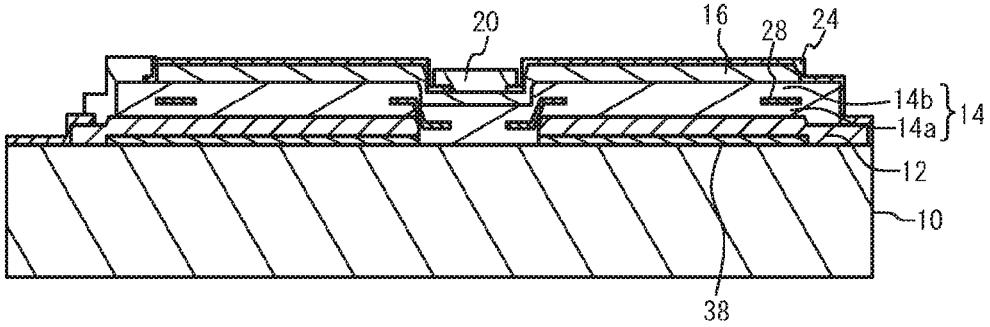

As illustrated in FIG. 7A, the upper electrode 16 is patterned into a desired shape by photolithography and etching. The upper electrode 16 may be formed by liftoff. The piezoelectric film 14 is patterned into a desired shape by photolithography and etching. This process exposes the extraction region of the lower electrode 12. As illustrated in FIG. 7B, the protective film 24 is formed on the lower electrode 12, the upper electrode 16, and the piezoelectric film 14 by, for example, sputtering or CVD. As illustrated in FIG. 7C, the protective film 24 is patterned into a desired shape by photolithography and etching. At this time, the protective film 24 on the lower electrode 12 and the upper electrode 16 is removed. The wiring line 20 is formed on the lower electrode 12 and the upper electrode 16 by vacuum evaporation, sputtering, or plating.

Figure 7D:
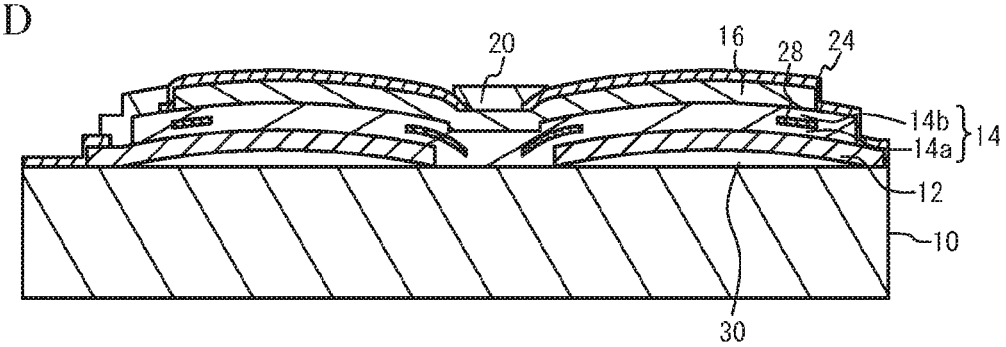

As illustrated in FIG. 7D, an etching liquid for etching the sacrifice layer 38 is introduced into the sacrifice layer 38 below the lower electrode 12 through the hole portion 35 and the introduction path 33 (see FIG. 1A). This process removes the sacrifice layer 38. The stress of the multilayered film from the lower electrode 12 to the protective film 24 is configured to be a compression stress. This configuration allows the multilayered film to bulge out to the side opposite to the substrate 10 so as to separate from the substrate 10 when the sacrifice layer 38 is removed. The air gap 30 having a dome-shaped bulge is formed between the lower electrode 12 and the substrate 10. The above described process allows the piezoelectric thin film resonator of the first embodiment to be fabricated.

FIG. 8A through FIG. 14B illustrate the method of fabricating the piezoelectric thin film resonator of the first embodiment, are cross-sectional views around the extraction region, and illustrate the details of FIG. 7C. FIG. 8A through FIG. 14A are enlarged views around the extraction region 57 of the lower electrode 12, and FIG. 8B through FIG. 14B are enlarged views around the extraction region 58 of the upper electrode 16.

Figure 8A:
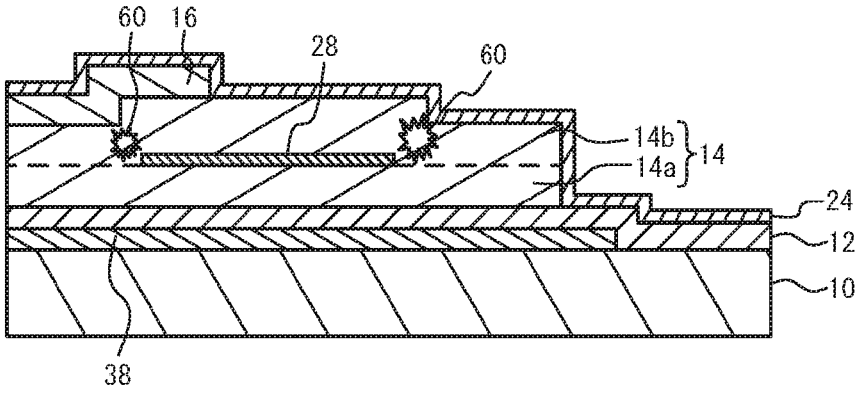
FIG. 8A and FIG. 8B illustrate the method of fabricating the piezoelectric thin film resonator of the first embodiment, and are cross-sectional views (No. 1) around the extraction region.
Figure 8B:
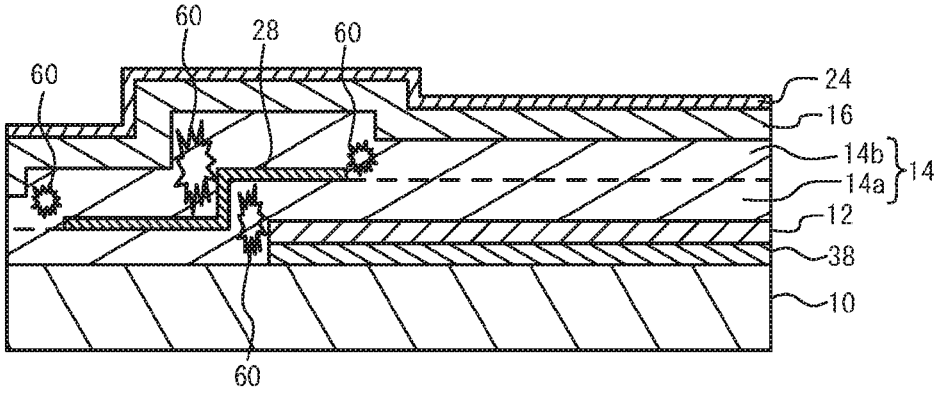

FIG. 8A and FIG. 8B are diagrams corresponding to FIG. 7B. In the piezoelectric film 14 formed on a step part, a crystallinity deterioration region 60 in which the crystallinity is disturbed is formed. A crack and/or a porosity is easily formed in the crystallinity deterioration region 60. In other words, a void is easily formed. For example, the outer peripheral part and the inner peripheral part of the insertion film 28 on the piezoelectric film 14*a* form steps. Thus, the crystallinity deterioration region 60 is formed in the piezoelectric film 14*b* on the outer periphery and the inner periphery of the insertion film 28. As described in Patent Document 1, even when the end face of the insertion film 28 is inclined, the crystallinity deterioration region 60 is formed.

Figure 9A:
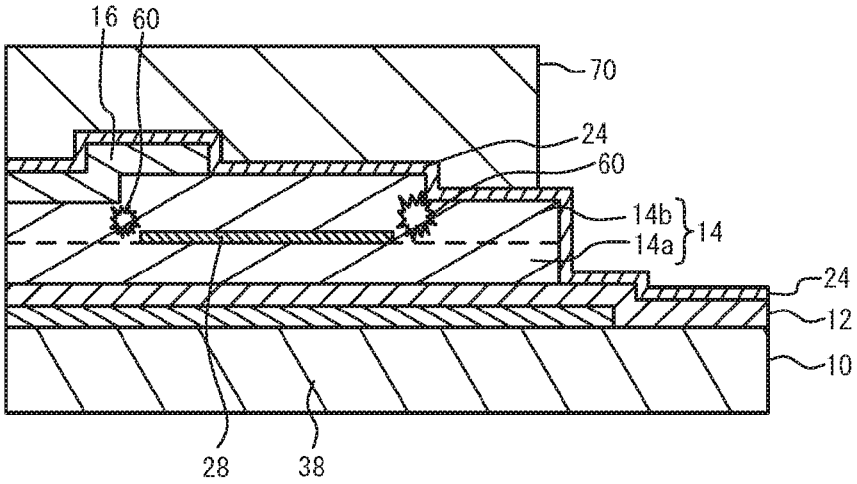
FIG. 9A and FIG. 9B illustrate the method of fabricating the piezoelectric thin film resonator of the first embodiment, and are cross-sectional views (No. 2) around the extraction region.
Figure 9B:
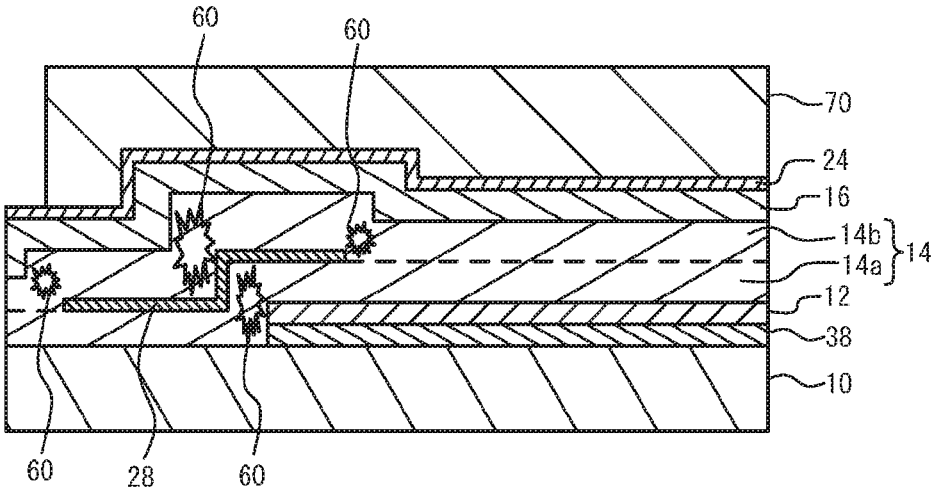

As illustrated in FIG. 9A and FIG. 9B, a photoresist 70 is formed on the protective film 24. The photoresist 70 includes an aperture in the extraction region of the lower electrode 12 and an aperture in the extraction region of the upper electrode 16. At this time, in FIG. 9A, the photoresist 70 is formed to the outside of the outer periphery of the insertion film 28.

Figure 10A:
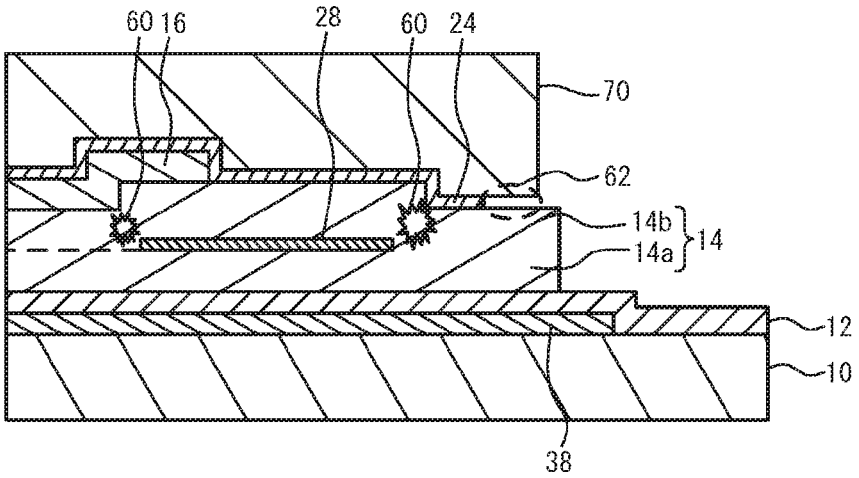
FIG. 10A and FIG. 10B illustrate the method of fabricating the piezoelectric thin film resonator of the first embodiment, and are cross-sectional views (No. 3) around the extraction region.
Figure 10B:
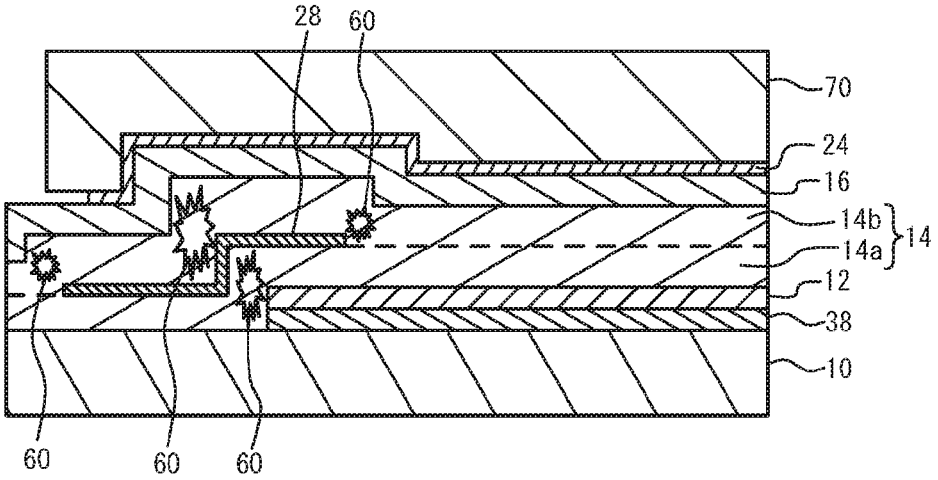

As illustrated in FIG. 10A and FIG. 10B, the protective film 24 is etched by using the photoresist 70 as a mask. When the protective film 24 is a silicon oxide film, the etching liquid is, for example, a hydrofluoric-acid-based aqueous solution. As indicated by a region 62, the protective film 24 is side-etched. Even when the protective film 24 is side-etched as illustrated in FIG. 10B, the protective film 24 is formed to further out than the outer periphery of the insertion film 28. This configuration inhibits the crystallinity deterioration region 60 from being exposed to the etching liquid.

Figure 11A:
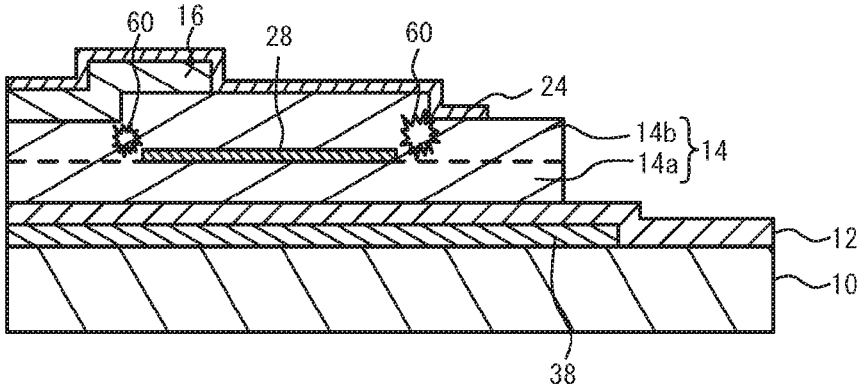
FIG. 11A and FIG. 11B illustrate the method of fabricating the piezoelectric thin film resonator of the first embodiment, and are cross-sectional views (No. 4) around the extraction region.
Figure 11B:
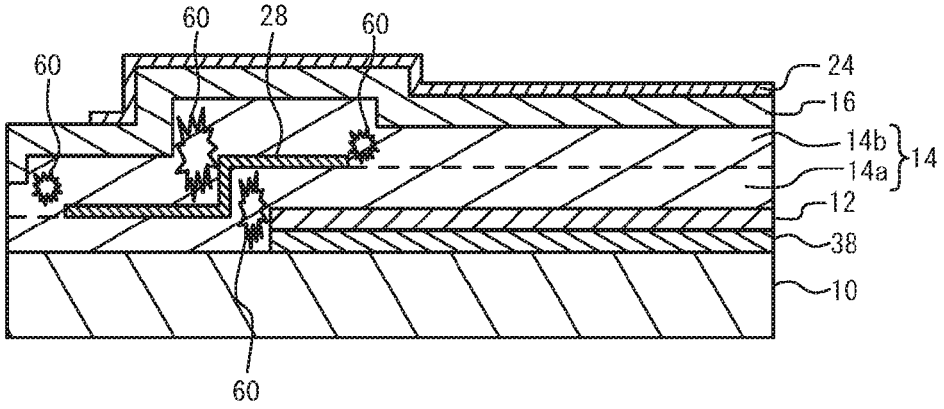

As illustrated in FIG. 11A and FIG. 11B, the photoresist 70 is removed.

Figure 12A:
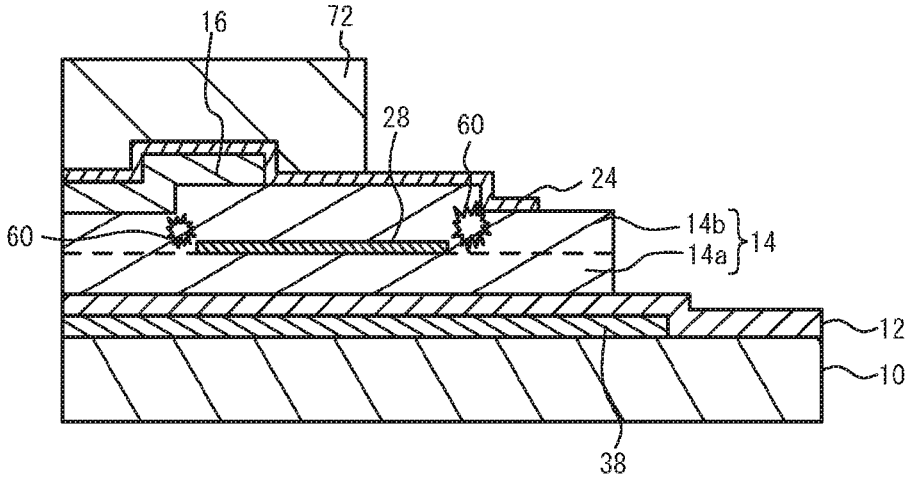
FIG. 12A and FIG. 12B illustrate the method of fabricating the piezoelectric thin film resonator of the first embodiment, and are cross-sectional views (No. 5) around the extraction region.
Figure 12B:
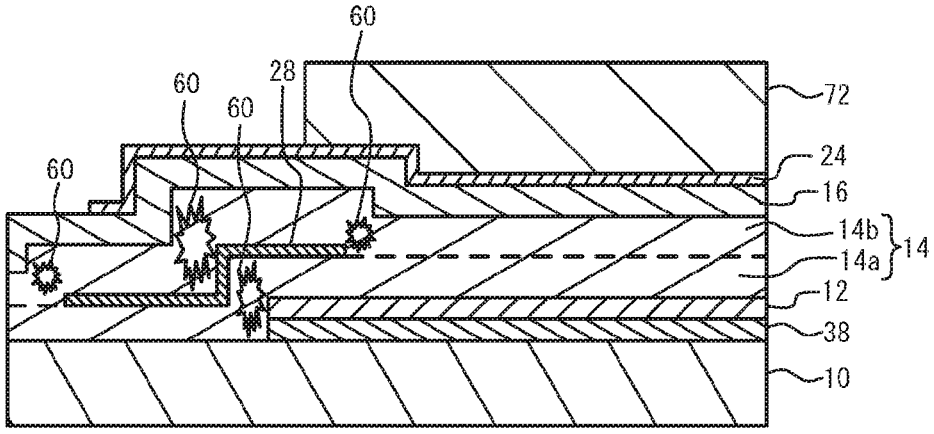

As illustrated in FIG. 12A and FIG. 12B, a photoresist 72 is formed on the protective film 24. The photoresist 72 includes an aperture in the extraction region of the lower electrode 12 and an aperture in the extraction region of the upper electrode 16. The photoresist 72 is formed so that the photoresist 72 is smaller than the protective film 24 and included in the protective film 24 in planar view.

Figure 13A:
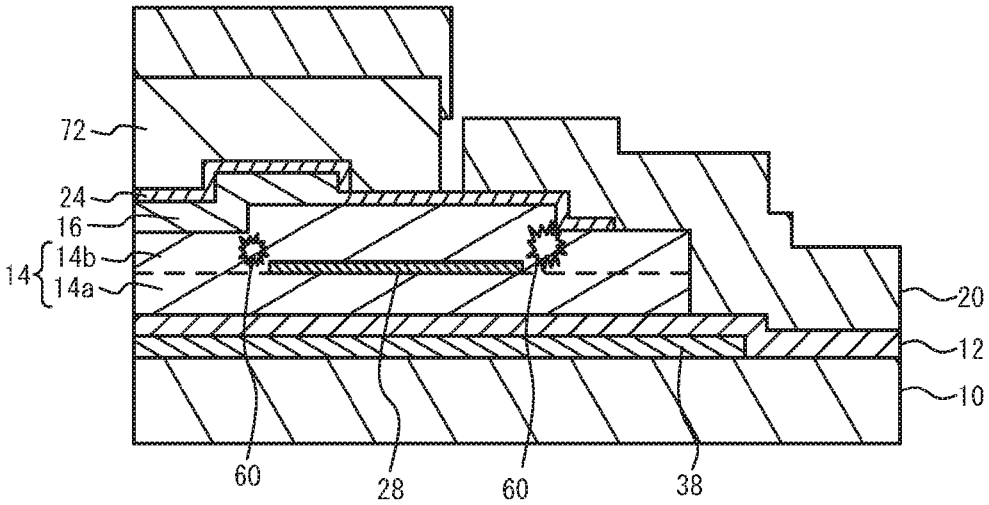
FIG. 13A and FIG. 13B illustrate the method of fabricating the piezoelectric thin film resonator of the first embodiment, and are cross-sectional views (No. 6) around the extraction region.
Figure 13B:
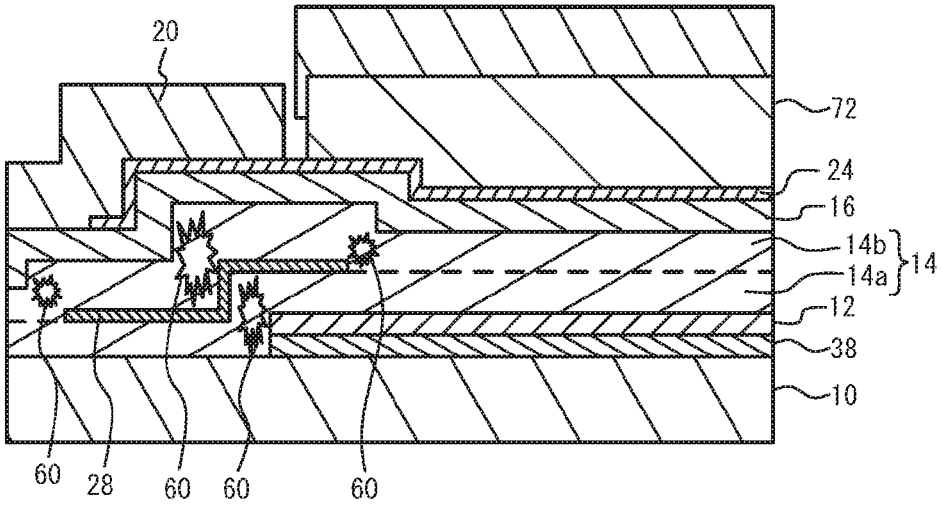

As illustrated in FIG. 13A and FIG. 13B, the wiring line 20 is formed by vacuum evaporation. Since the inner periphery of the wiring line 20 is located further in than the outer periphery of the protective film 24, the piezoelectric film 14 is inhibited from being exposed.

Figure 14A:
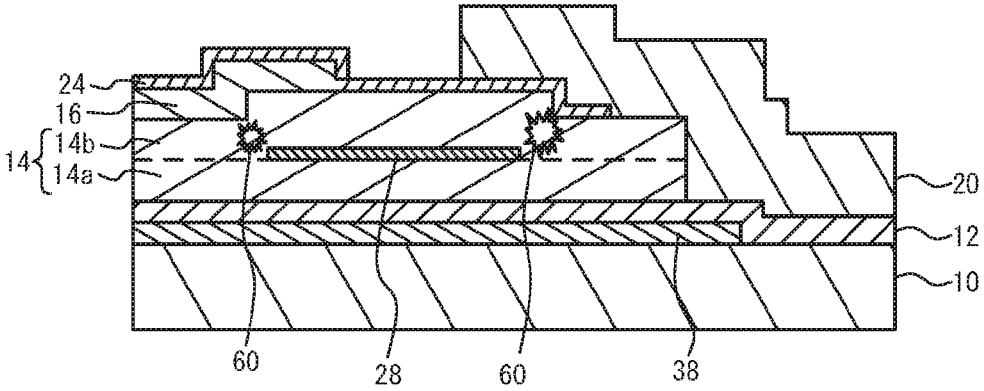
FIG. 14A and FIG. 14B illustrate the method of fabricating the piezoelectric thin film resonator of the first embodiment, and are cross-sectional views (No. 7) around the extraction region.
Figure 14B:
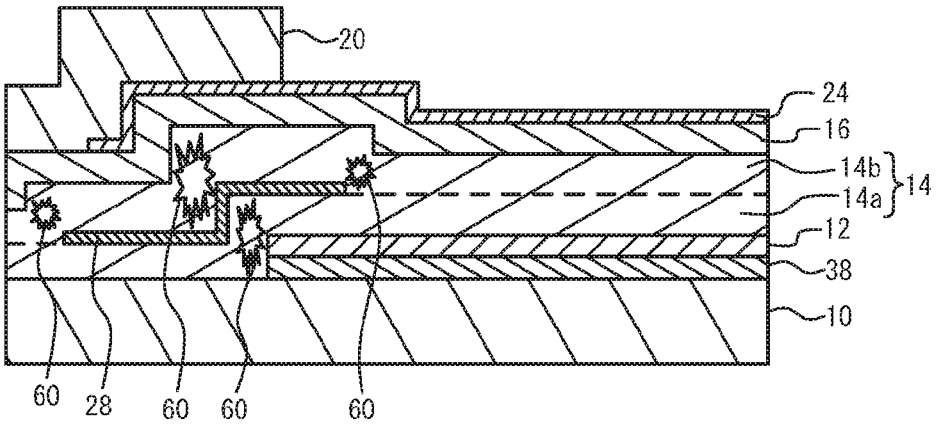

As illustrated in FIG. 14A and FIG. 14B, the metal layer on the photoresist 72 is lifted off by removing the photoresist 72. The above described process achieves the state illustrated in FIG. 7C.

Figure 15A:
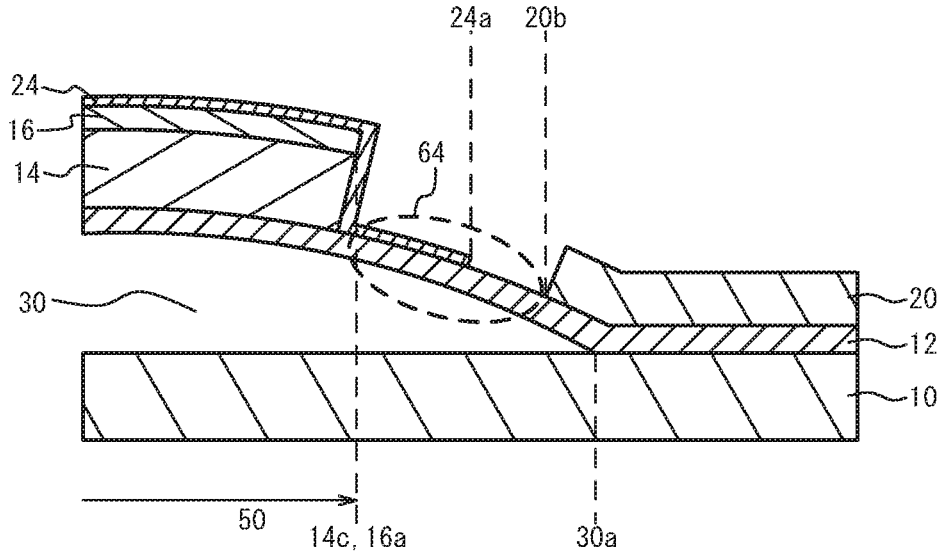
FIG. 15A and FIG. 15B are cross-sectional views around the extraction region of a piezoelectric thin film resonator in accordance with a first comparative example.
Figure 15B:
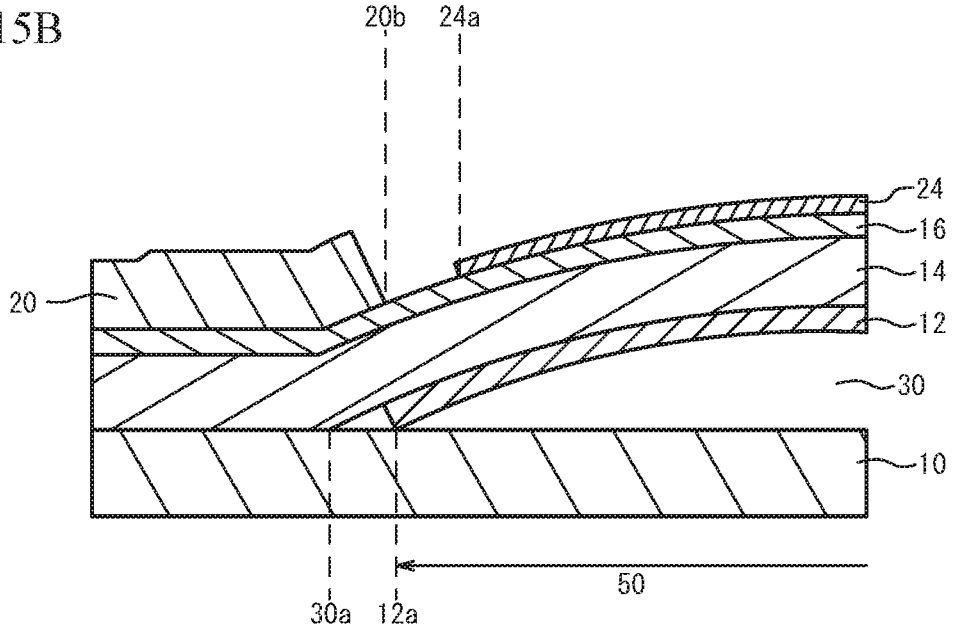

The advantages of the first embodiment will be described with comparative examples. FIG. 15A and FIG. 15B are cross-sectional views around the extraction region of a piezoelectric thin film resonator in accordance with a first comparative example. As illustrated in FIG. 15A and FIG. 15B, in the first comparative example, the insertion film 28 is not located. As illustrated in FIG. 15A, the outer periphery 14*c* of the piezoelectric film 14 virtually corresponds to the outer periphery 16*a* of the upper electrode 16. The resonance region 50 is smaller than the air gap 30 in planar view. Thus, the outer periphery 14*c* of the piezoelectric film 14 is located further in than the outer periphery 30*a* of the air gap 30.

Accordingly, in a region 64, the resonance region 50 is supported by only the lower electrode 12 and the protective film 24. The region 64 is easily damaged by physical impact and/or thermal shock.

Figure 16A:
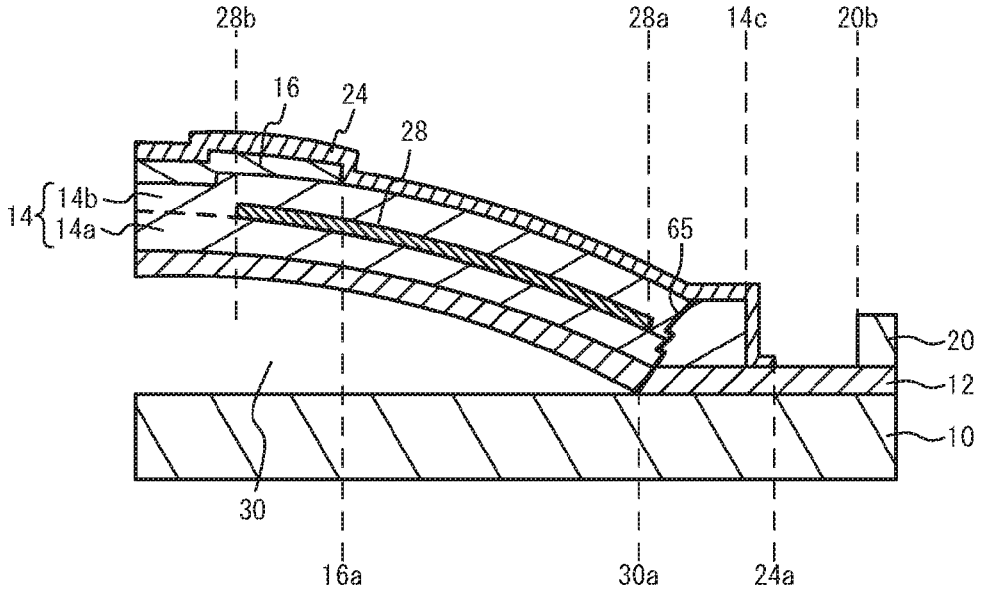
FIG. 16A and FIG. 16B are cross-sectional views around the extraction region of a piezoelectric thin film resonator in accordance with a second comparative example.
Figure 16B:
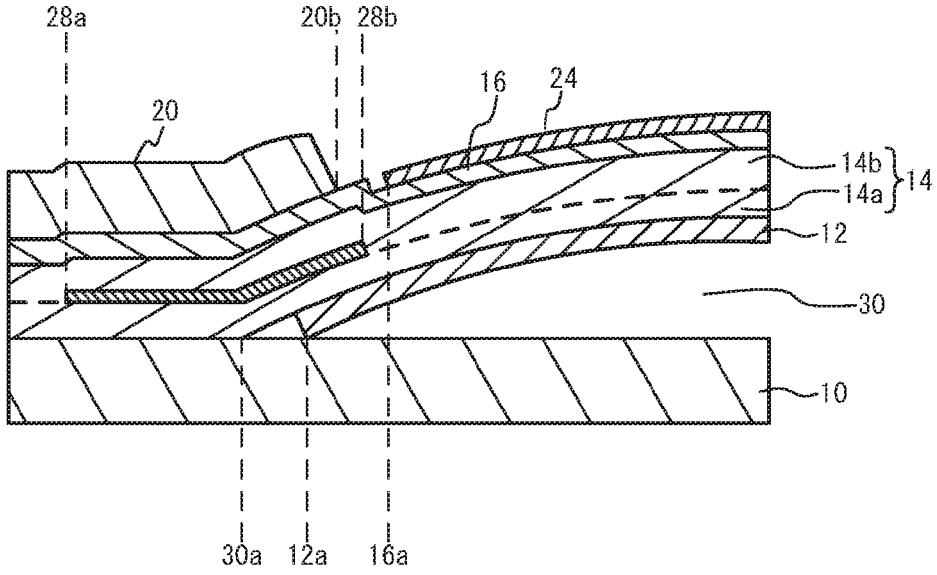

FIG. 16A and FIG. 16B are cross-sectional views around the extraction region of a piezoelectric thin film resonator in accordance with a second comparative example. As illustrated in FIG. 16A and FIG. 16B, in the second comparative example, the insertion film 28 is inserted into the piezoelectric film 14. As illustrated in FIG. 16A, the outer periphery 14*c* of the piezoelectric film 14 is located further out than the outer periphery 30*a* of the air gap 30. Thus, unlike the first comparative example, there is no region 64 where the resonance region 50 is supported by only the lower electrode 12 and the protective film 24. However, since the curvature of the piezoelectric film 14 rapidly changes in the outer periphery 30*a* of the air gap 30, a crack 65 is formed in the piezoelectric film 14. When the piezoelectric film 14 has a columnar structure, especially the crack 65 is easily formed. The crack 65 may be formed in the lower electrode 12 due to the crack 65 of the piezoelectric film 14. The formation of the crack 65 in the lower electrode 12 may break the lower electrode 12. The crack 65 of the piezoelectric film 14 is also formed in FIG. 16B. However, in FIG. 16B, since the upper electrode 16 is extracted, the effect is small.

Figure 17A:
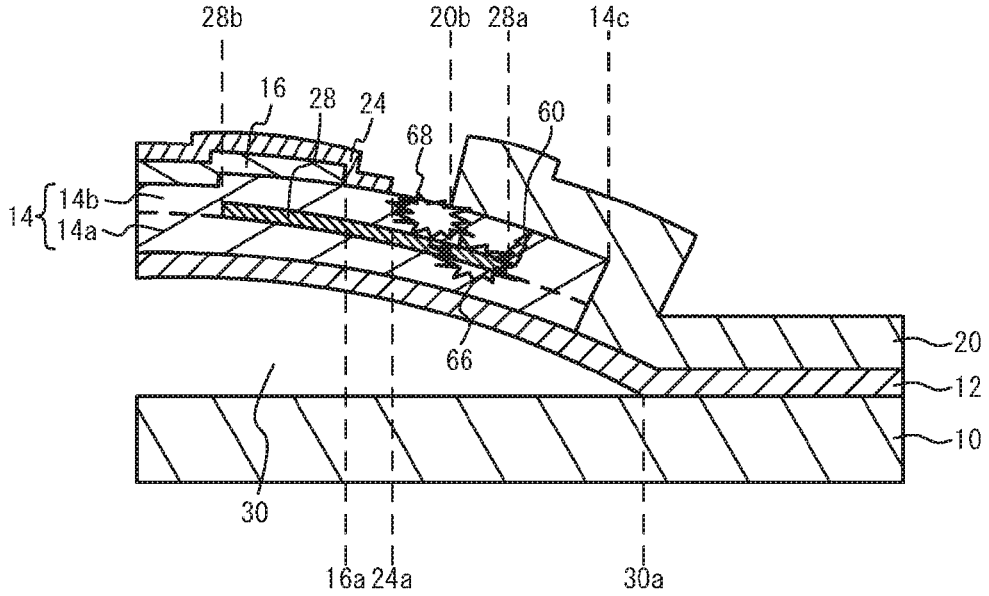
FIG. 17A and FIG. 17B are cross-sectional views around the extraction region of a piezoelectric thin film resonator in accordance with a third comparative example.
Figure 17B:
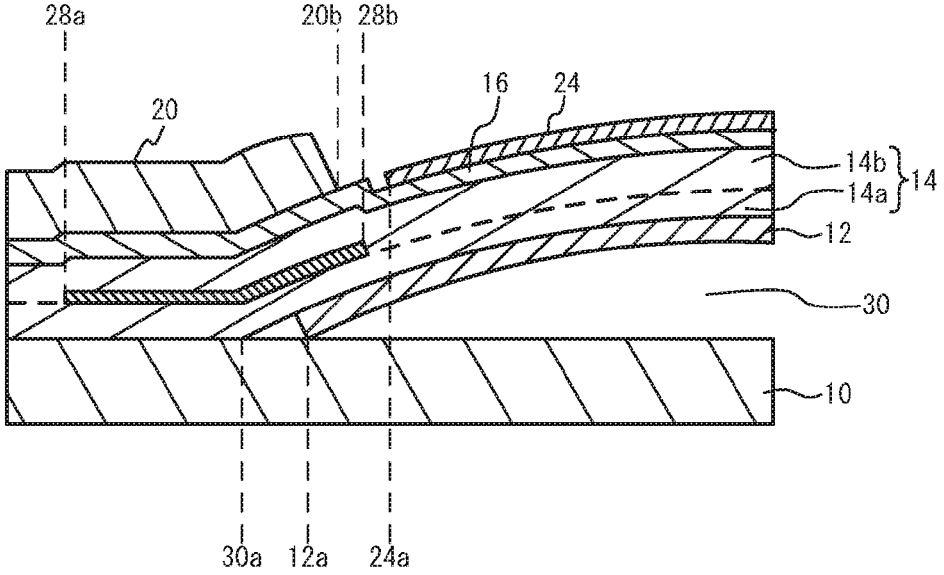

FIG. 17A and FIG. 17B are cross-sectional views around the extraction region of a piezoelectric thin film resonator in accordance with a third comparative example. As illustrated in FIG. 17B, the extraction region of the upper electrode 16 is the same as that of the second comparative example. As illustrated in FIG. 17A, the outer periphery 14*c* of the piezoelectric film 14 is located further in than the outer periphery 30*a* of the air gap 30. This configuration inhibits the formation of the crack 65 in the piezoelectric film 14 and the lower electrode 12 described in the second comparative example. The inner periphery 20*b* of the wiring line 20 is configured to be located further in than the outer periphery 14*c* of the piezoelectric film 14. This configuration eliminates a region supported by only the lower electrode 12 and the protective film 24 described in the first comparative example. However, in a region in which the piezoelectric film 14 is exposed, a deterioration region 68 is formed in the piezoelectric film 14. In addition, exposed is the crystallinity deterioration region 60 of the outer periphery 28*a* of the insertion film 28 when the wiring line 20 is formed. Thus, deterioration regions 66 are formed in the piezoelectric film 14 and the insertion film 28.

FIG. 18A through FIG. 22B illustrate a method of fabricating the piezoelectric thin film resonator of the third comparative example, and are cross-sectional views around the extraction region. FIG. 18A through FIG. 22A are enlarged views around the extraction region 57 of the lower electrode 12, and FIG. 18B through FIG. 22B are enlarged views around the extraction region 58 of the upper electrode 16.

Figure 18A:
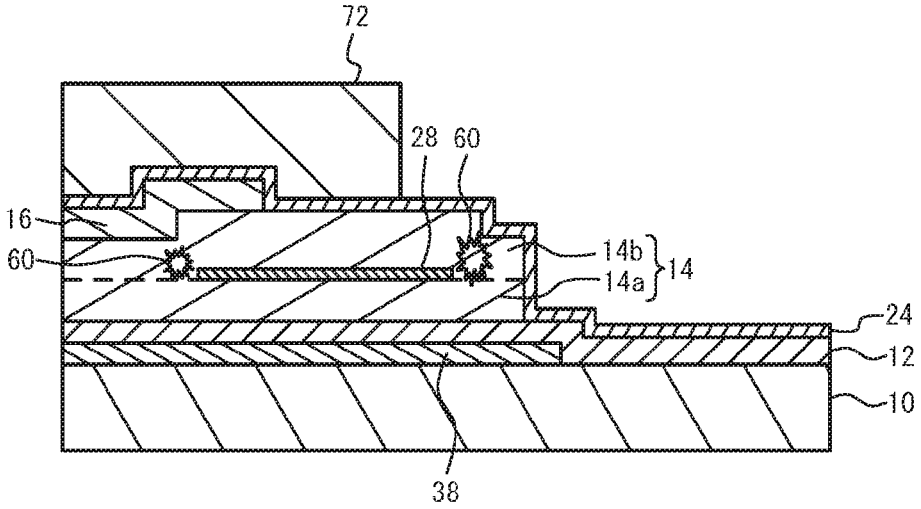
FIG. 18A and FIG. 18B illustrate a method of fabricating the piezoelectric thin film resonator of the third comparative example, and are cross-sectional views (No. 1) around the extraction region.
Figure 18B:
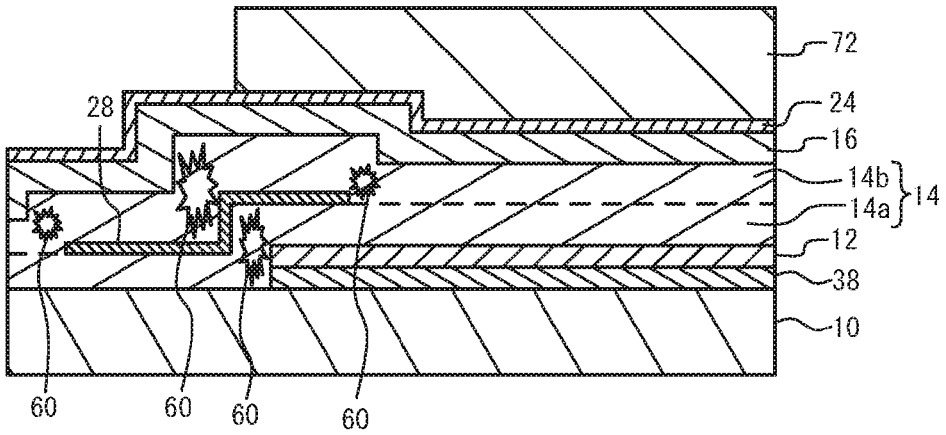

As illustrated in FIG. 18A and FIG. 18B, after the steps illustrated in FIG. 9A and FIG. 9B of the first embodiment, the photoresist 72 is formed on the protective film 24. The photoresist 72 is a mask for etching the protective film 24 and forming the wiring line 20. As illustrated in FIG. 18A, the photoresist 72 is not formed on the outer periphery of the insertion film 28.

Figure 19A:
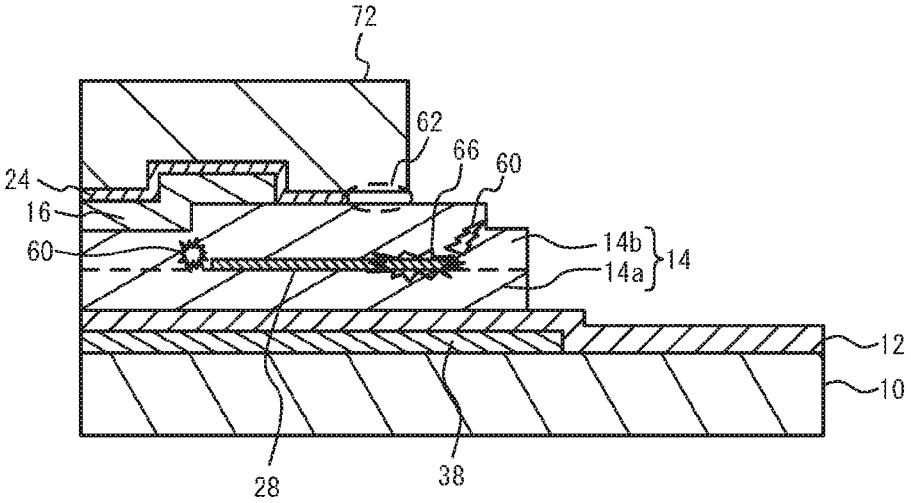
FIG. 19A and FIG. 19B illustrate the method of fabricating the piezoelectric thin film resonator of the third comparative example, and are cross-sectional views (No. 2) around the extraction region.
Figure 19B:
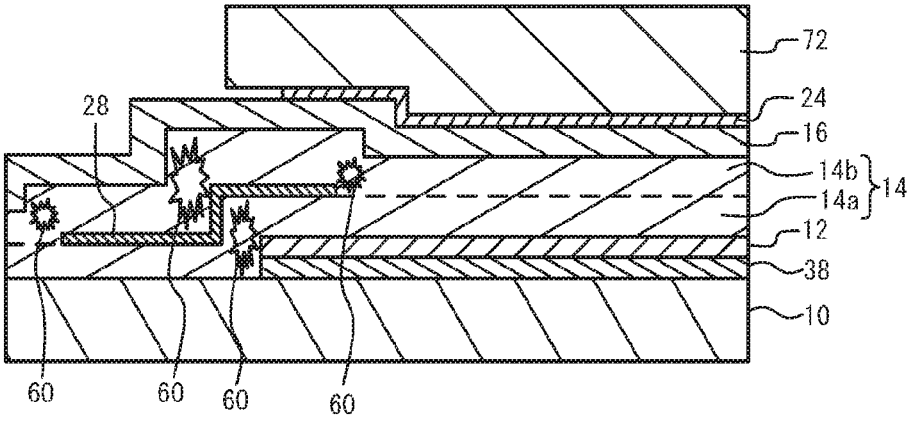

As illustrated in FIG. 19A and FIG. 19B, the protective film 24 is etched by using the photoresist 72 as a mask. As indicated by the region 62 of FIG. 19A, the protective film 24 is side-etched. Additionally, the crystallinity deterioration region 60 near the outer periphery of the insertion film 28 is exposed to the etching liquid for the protective film 24. Therefore, the crystallinity deterioration region 60 is etched. Alternatively, the etching liquid penetrates from a crack formed in the crystallinity deterioration region 60, and etches the insertion film 28, forming the deterioration region 66. For example, when the protective film 24 is etched with a hydrofluoric-acid-based etching liquid, the insertion film 28 is etched in a case where the insertion film 28 is a silicon oxide film.

Figure 20A:
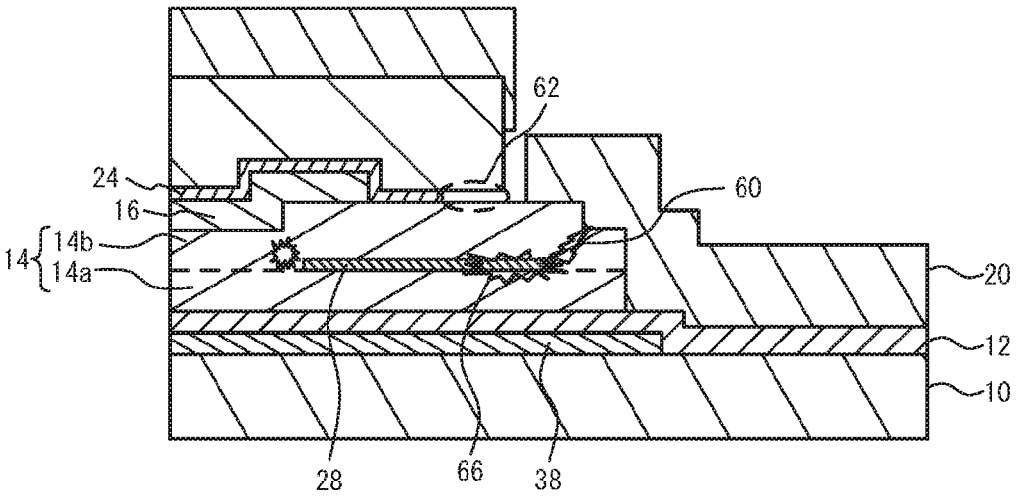
FIG. 20A and FIG. 20B illustrate the method of fabricating the piezoelectric thin film resonator of the third comparative example, and are cross-sectional views (No. 3) around the extraction region.
Figure 20B:
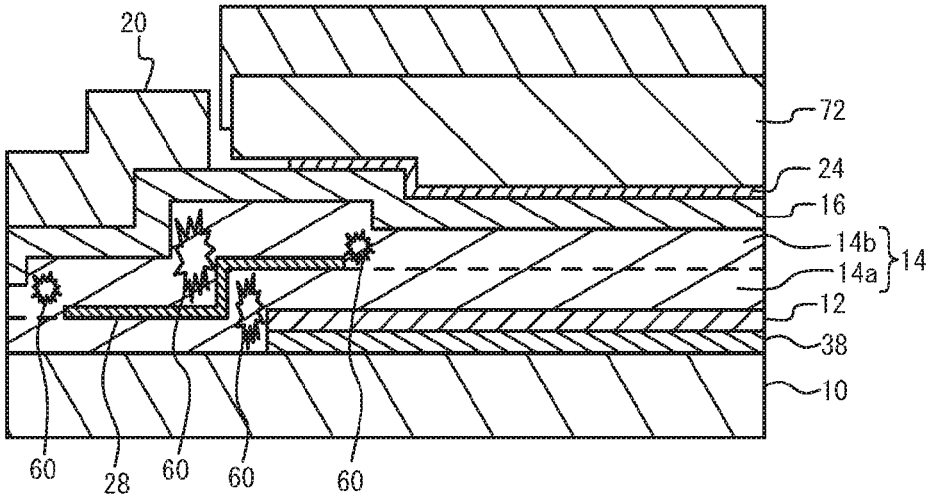

As illustrated in FIG. 20A and FIG. 20B, the wiring line 20 is formed with the photoresist 72 left. As illustrated in FIG. 20A, the wiring line 20 is not formed in the region 62 where the protective film 24 is side-etched.

Figure 21A:
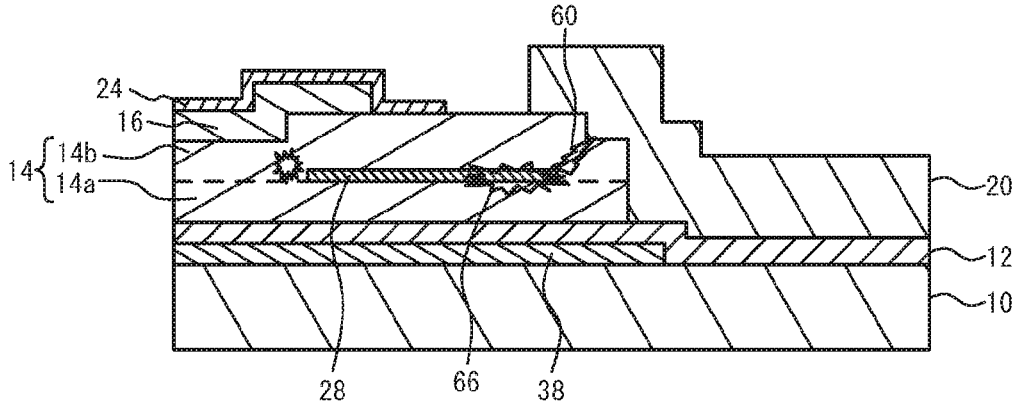
FIG. 21A and FIG. 21B illustrate the method of fabricating the piezoelectric thin film resonator of the third comparative example, and are cross-sectional views (No. 4) around the extraction region.
Figure 21B:
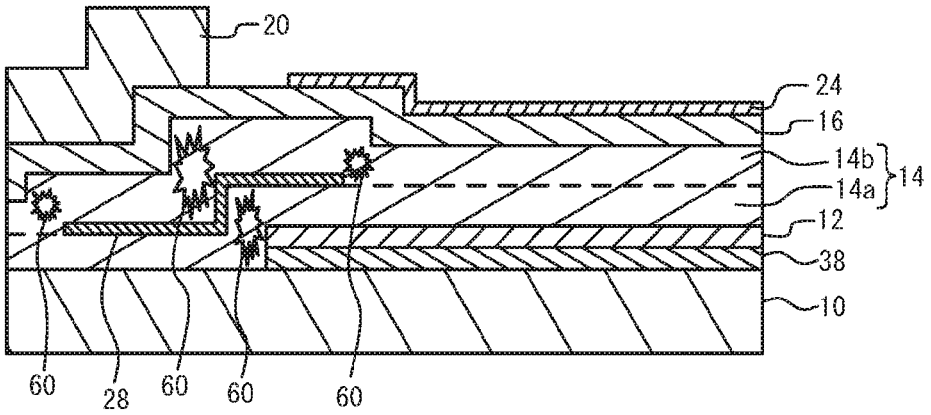

As illustrated in FIG. 21A and FIG. 21B, the photoresist 72 is removed. This process lifts off the metal layer on the photoresist 72. As illustrated in FIG. 21A, the piezoelectric film 14 is exposed between the protective film 24 and the wiring line 20.

Figure 22A:
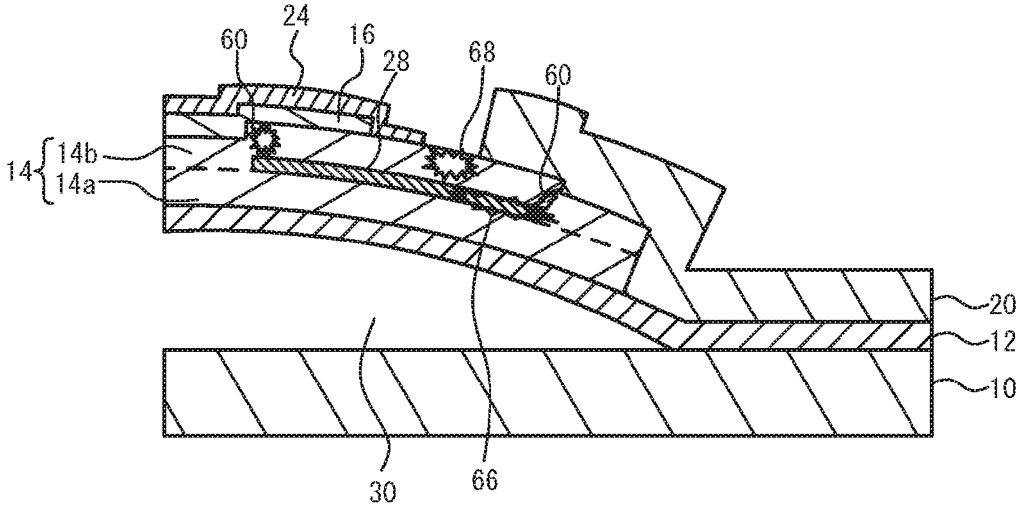
FIG. 22A and FIG. 22B illustrate the method of fabricating the piezoelectric thin film resonator of the third comparative example, and are cross-sectional views (No. 5) around the extraction region.
Figure 22B:
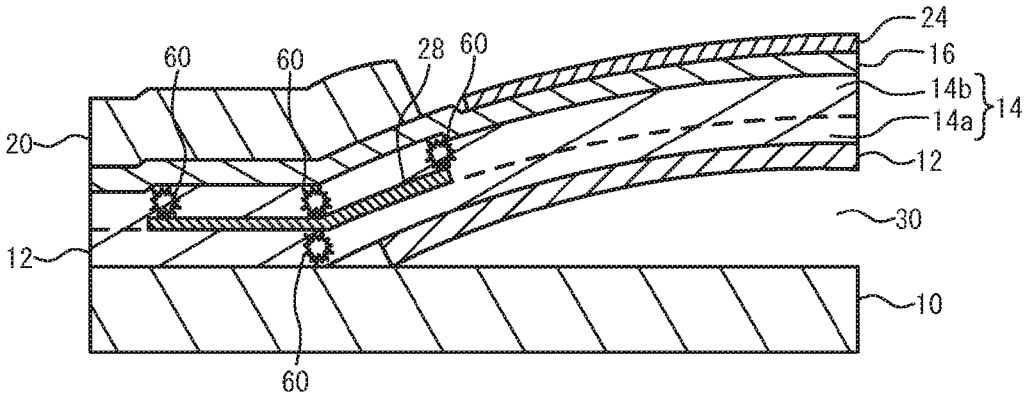

As illustrated in FIG. 22A and FIG. 22B, the sacrifice layer 38 is removed. As illustrated in FIG. 22A, when the piezoelectric film 14 between the protective film 24 and the wiring line 20 is exposed to the etching liquid for removing the sacrifice layer 38, the piezoelectric film 14 deteriorates, and the deterioration region 68 is formed. When hydrofluoric acid, nitric acid, or buffered hydrofluoric acid is used as the etching liquid for removing the sacrifice layer 38, the piezoelectric film 14 made from aluminum nitride is etched. As described above, in the third comparative example, the deterioration regions 66 and 68 are formed in the piezoelectric film 14 and the insertion film 28.

According to the first embodiment, in the extraction region of the lower electrode 12, the outer periphery 28*a* of the insertion film 28 is located further out than the outer periphery 16*a* of the upper electrode 16 as illustrated in FIG. 2A. This configuration secures a margin for misalignment between the insertion film 28 and the resonance region 50. The outer periphery 28*a* of the insertion film 28 is located further in than the outer periphery 14*c* of the piezoelectric film 14. This configuration eliminates the need for etching of the insertion film 28 at the time of etching of the piezoelectric film 14. The outer periphery 24*a* of the protective film 24 is located further out than the outer periphery 28*a* of the insertion film 28. This configuration inhibits the crystallinity deterioration region 60 of the piezoelectric film 14 on the outer periphery 28*a* of the insertion film 28 from being exposed to an etching liquid when the protective film 24 is etched. Thus, the formation of the deterioration region 66 described in the third comparative example is inhibited. The wiring line 20 covers the outer periphery 24*a* of the protective film 24. This configuration inhibits the piezoelectric film 14 from being exposed between the protective film 24 and the wiring line 20. Accordingly, the formation of the deterioration region 68 described in the third comparative example is inhibited when the sacrifice layer 38 is etched, for example.

Although the etching step of the protective film 24 has been described as an example of a step during which the deterioration region 66 is formed, the deterioration region 66 may be formed from the crystallinity deterioration region 60 during steps after the patterning step of the protective film 24 or by various factors after the completion of the piezoelectric thin film resonator. Although the etching step of the sacrifice layer 38 has been described as an example of a step during which the deterioration region 68 is formed, the deterioration region 68 may be formed in the piezoelectric film 14 during steps after the formation step of the wiring line 20 or by various factors after the completion of the piezoelectric thin film resonator.

As illustrated in FIG. 2A, in the extraction region 57 of the lower electrode 12, the inner periphery 20*b* of the wiring line 20 is located further out than the outer periphery 16*a* of the upper electrode 16. This configuration inhibits the wiring line 20 from being formed in the resonance region 50, reducing the deterioration of the characteristics.

Furthermore, in the extraction region 57 of the lower electrode 12, the outer periphery 14*c* of the piezoelectric film 14 is located further in than the outer periphery 30*a* of the air gap 30. This configuration reduces the deterioration of the lower electrode 12 described in the second comparative example.

To secure the margin for alignment between the wiring line 20 and the protective film 24, in the extraction region of the lower electrode 12, the inner periphery 20*b* of the wiring line 20 may be located further in than the outer periphery 28*a* of the insertion film 28.

As illustrated in FIG. 2B, in the extraction region 58 of the upper electrode 16, the wiring line 20 covers the outer periphery 24*a* of the protective film 24. This configuration inhibits the formation of the deterioration region 68.

In the extraction region 58 of the upper electrode 16, the inner periphery 20*b* of the wiring line 20 is located further out than the outer periphery 16*a* of the upper electrode 16. This configuration prevents the wiring line 20 from being formed in the resonance region 50, inhibiting the deterioration of the characteristics.

Figure 23:
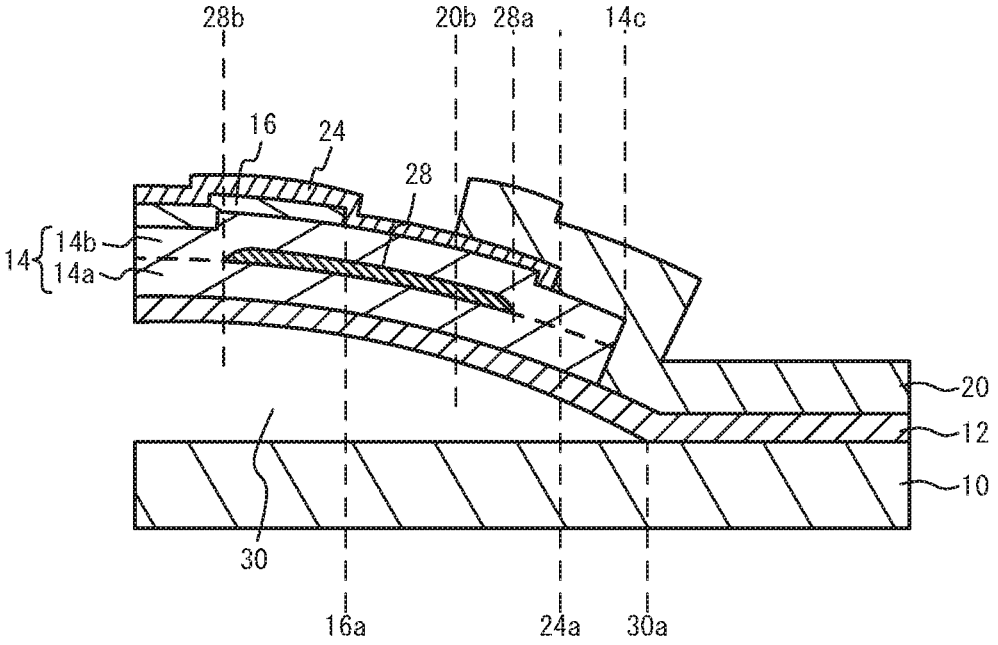
FIG. 23 is a cross-sectional view around the extraction region of a piezoelectric thin film resonator in accordance with a first variation of the first embodiment.

FIG. 23 is a cross-sectional view around the extraction region of a piezoelectric thin film resonator in accordance with a first variation of the first embodiment. As illustrated in FIG. 23, the end face of the insertion film 28 is inclined so that the lower surface of the insertion film 28 is larger than the upper surface of the insertion film 28. Even when the end face of the insertion film 28 is inclined, the crystallinity deterioration region 60 is formed. Thus, the outer periphery 24*a* of the protective film 24 is preferably located further out than the outer periphery 28*a* of the insertion film 28.

Figure 24A:
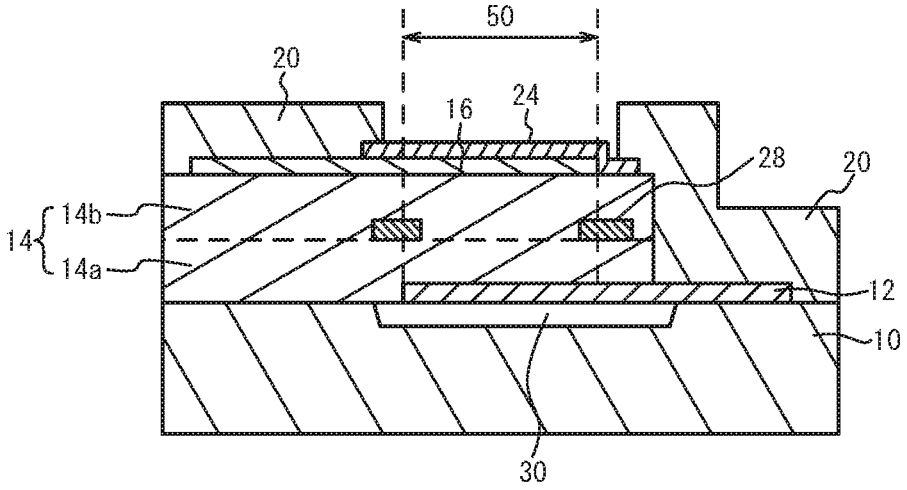
FIG. 24A is a cross-sectional view of a piezoelectric thin film resonator in accordance with a second variation of the first embodiment.
Figure 24B:
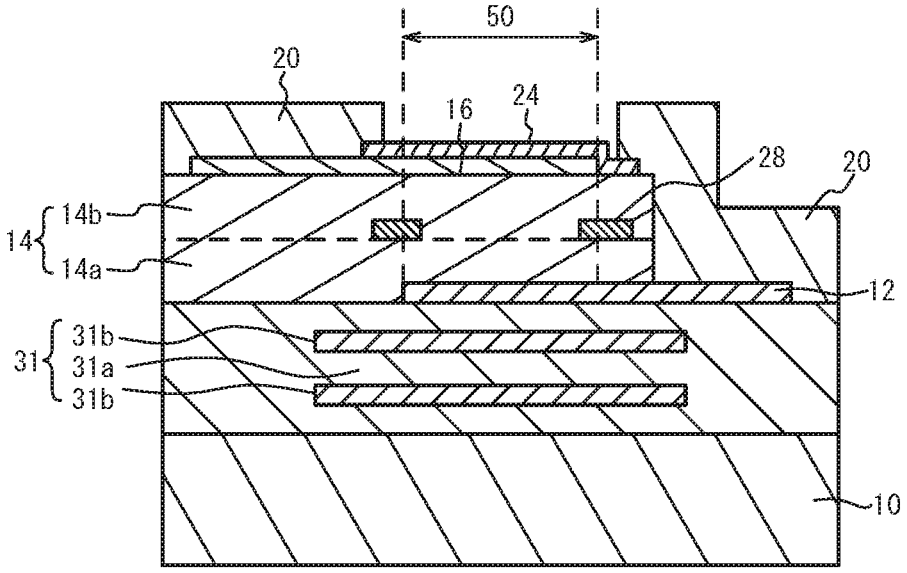
FIG. 24B is a cross-sectional view of a piezoelectric thin film resonator in accordance with a third variation of the first embodiment.

Second and third variations of the first embodiment change the structure of the air gap. FIG. 24A is a cross-sectional view of a piezoelectric thin film resonator of the second variation of the first embodiment, and FIG. 24B is a cross-sectional view of a piezoelectric thin film resonator of the third variation of the first embodiment. As illustrated in FIG. 24A, a recessed portion is formed on the upper surface of the substrate 10. The lower electrode 12 is flatly formed on the substrate 10. Thus, the air gap 30 is formed in the recessed portion of the substrate 10. The air gap 30 is formed to include the resonance region 50. Other configurations are the same as those of the first embodiment, and the description is omitted. The air gap 30 may be formed to penetrate through the substrate 10. An insulating film may be formed to contact the lower surface of the lower electrode 12. That is to say, the air gap 30 may be formed between the substrate 10 and the insulating film contacting the lower electrode 12. The insulating film may be, for example, an aluminum nitride film.

As illustrated in FIG. 24B, an acoustic mirror 31 is formed below the lower electrode 12 of the resonance region 50. The acoustic mirror 31 includes films 31*a* with low acoustic impedance and films 31*b* with high acoustic impedance alternately stacked. Each of the films 31*a* and 31*b* has a film thickness of, for example, $\lambda/4$ ($\lambda$ is the wavelength of the acoustic wave). The stacking number of the film 31*a* and the film 31*b* may be freely selected. Other configurations are the same as those of the first embodiment, and the description is omitted.

As described in the first embodiment and the first and second variations, the piezoelectric thin film resonator may be an FBAR (Film Bulk Acoustic Resonator) in which the air gap 30 is formed between the substrate 10 and the lower electrode 12 in the resonance region 50. As described in the third variation of the first embodiment, the piezoelectric thin film resonator may be an SMR (Solidly Mounted Resonator) in which the acoustic mirror 31 that reflects the acoustic wave propagating through the piezoelectric film 14 is located below the lower electrode 12 in the resonance region 50.

In the first embodiment and its variations, the resonance region 50 has an elliptical shape, but may have other shape. For example, the resonance region 50 may have a polygonal shape such as a quadrangle shape or a pentagonal shape. A slit in which the insertion film 28 is not formed may be located in a part of the outer peripheral region 52 of the resonance region 50.

Second Embodiment

Figure 25A:
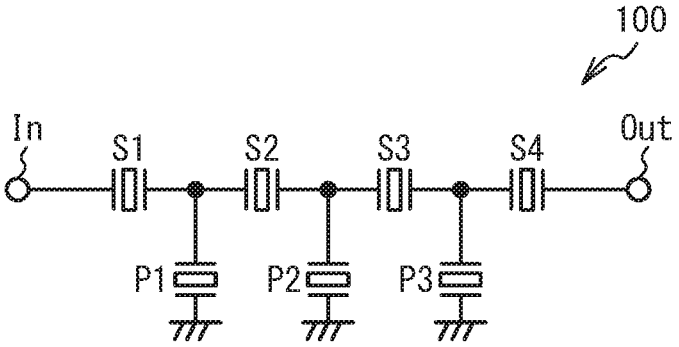
FIG. 25A and FIG. 25B are circuit diagrams illustrating a filter and a duplexer in accordance with a second embodiment, respectively.
Figure 25B:
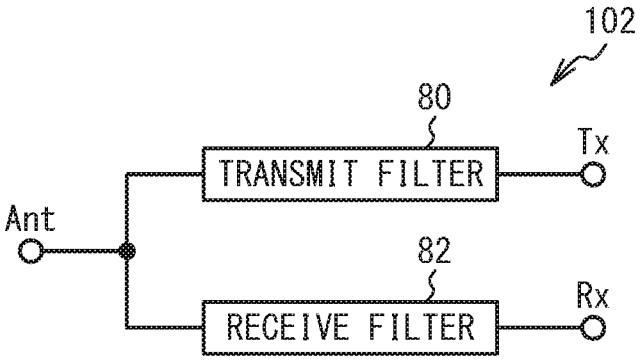

A second embodiment uses the piezoelectric thin film resonators of the first embodiment and its variations for a filter or a duplexer. FIG. 25A and FIG. 25B are circuit diagrams illustrating a filter and a duplexer in accordance with the second embodiment, respectively. As illustrated in FIG. 25A, a filter 100 includes series resonators S1 through S4 and parallel resonators P1 through P3. The series resonators S1 through S4 are connected in series between an input terminal In and an output terminal Out. The parallel resonators P1 through P3 are connected in parallel between the input terminal In and the output terminal Out. At least one of the series resonators S1 through S4 and the parallel resonators P1 through P3 may be any one of the piezoelectric thin film resonators of the first embodiment and its variations. The number and the connection of the series resonators S1 through S4 and the parallel resonators P1 through P3 are designed as appropriate.

As illustrated in FIG. 25B, a duplexer 102 includes a transmit filter 80 and a receive filter 82. The transmit filter 80 is connected between a common terminal Ant and a transmit terminal Tx. The receive filter 82 is connected between the common terminal Ant and a receive terminal Rx. The transmit filter 80 passes signals within the transmit band, among signals input from the transmit terminal Tx, to the common terminal Ant, and suppresses other signals. The receive filter 82 passes signals within the receive band, among signals input from the common terminal Ant, to the receive terminal Rx, and suppresses other signals. At least one of the transmit filter 80 and the receive filter 82 may be the filter 100 of FIG. 25A.

Although the embodiments of the present invention have been described in detail, it is to be understood that the various change, substitutions, and alterations could be made hereto without departing from the spirit and scope of the invention.

What is claimed is:

1. A piezoelectric thin film resonator comprising:

a substrate;

a piezoelectric film that is located on the substrate;

a lower electrode and an upper electrode that face each other across at least a part of the piezoelectric film;

an insertion film that is inserted into the piezoelectric film, is located in at least a part of an outer peripheral region in a resonance region where the lower electrode and the upper electrode face each other across the piezoelectric film and outside the outer peripheral region, and is not located in a center region of the resonance region;

a protective film that is formed on the upper electrode and the piezoelectric film; and a wiring line that connects to the lower electrode in an extraction region of the lower electrode, wherein in the extraction region of the lower electrode, an outer periphery of the insertion film is located further out than an outer periphery of the upper electrode and is located further in than an outer periphery of the piezoelectric film, an outer periphery of the protective film is located further out than the outer periphery of the insertion film, and the wiring line covers the outer periphery of the protective film.

2. The piezoelectric thin film resonator according to claim 1, wherein in the extraction region of the lower electrode, an inner periphery of the wiring line is located further out than the outer periphery of the upper electrode.

3. The piezoelectric thin film resonator according to claim 1, wherein an air gap is located below the lower electrode, and in the extraction region of the lower electrode, the outer periphery of the piezoelectric film is located further in than an outer periphery of the air gap.

4. The piezoelectric thin film resonator according to claim 1, wherein in the extraction region of the lower electrode, an inner periphery of the wiring line is located further in than the outer periphery of the insertion film.

5. The piezoelectric thin film resonator according to claim 1, further comprising:

another wiring line connecting to the upper electrode in an extraction region of the upper electrode, wherein in the extraction region of the upper electrode, the another wiring line covers the outer periphery of the protective film.

6. The piezoelectric thin film resonator according to claim 1, wherein

Young's modulus of the insertion film is less than Young's modulus of the piezoelectric film.

7. A method of fabricating a piezoelectric thin film resonator comprising:

forming, on a substrate, a piezoelectric film, a lower electrode and an upper electrode facing each other across at least a part of the piezoelectric film, and an insertion film inserted into the piezoelectric film, located in at least a part of an outer peripheral region in a resonance region where the lower electrode and the upper electrode face each other across the piezoelectric film, located outside the outer peripheral region, and not located in a center region of the resonance region so that in an extraction region of the lower electrode, an outer periphery of the insertion film is located further out than an outer periphery of the upper electrode and is located further in than an outer periphery of the piezoelectric film;

forming a protective film on the upper electrode and the piezoelectric film;

etching a part of the protective film so that in the extraction region of the lower electrode, an outer periphery of the protective film is located further out than the outer periphery of the insertion film; and forming a wiring line connecting to the lower electrode in the extraction region of the lower electrode so that the wiring line covers the outer periphery of the protective film in the extraction region of the lower electrode.

8. The method according to claim 7, further comprising:

forming a sacrifice layer on the substrate; and forming an air gap between the substrate and the lower electrode by etching the sacrifice layer after the forming of the wiring line.

* * * * *